US011098949B2

(12) United States Patent
Wantland et al.

(10) Patent No.: US 11,098,949 B2
(45) Date of Patent: Aug. 24, 2021

(54) REFRIGERATOR APPLIANCE HAVING USB FEATURES

(71) Applicant: Haier US Appliance Solutions, Inc., Wilmington, DE (US)

(72) Inventors: Louis A. Wantland, Louisville, KY (US); Alisa Marie Stoops, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/547,876

(22) Filed: Aug. 22, 2019

(65) Prior Publication Data

US 2021/0055043 A1 Feb. 25, 2021

(51) Int. Cl.

| | |
|---|---|
| ***F25D 29/00*** | (2006.01) |
| ***F25D 25/02*** | (2006.01) |
| ***H01R 25/16*** | (2006.01) |

(52) U.S. Cl.

CPC ..... *F25D 29/005* (2013.01); *F25D 25/02* (2013.01); *H01R 25/162* (2013.01); *F25D 2325/021* (2013.01)

(58) Field of Classification Search

CPC ..... F25D 23/04; F25D 25/02; F25D 29/005; H01R 25/162

USPC ..... 312/401, 408, 405, 405.1

See application file for complete search history.

(56) References Cited

U.S. PATENT DOCUMENTS

| | | | | |
|---|---|---|---|---|
| 6,813,896 | B1 * | 11/2004 | Janke | F25D 25/02 62/126 |
| 9,157,678 | B2 * | 10/2015 | Kerner | F25D 23/00 |
| 9,455,506 | B2 * | 9/2016 | Kerner | F25D 23/00 |
| 9,989,298 | B1 | 6/2018 | Wantland et al. | |
| 10,027,866 | B2 | 7/2018 | Carlotto et al. | |
| 2009/0102337 | A1 * | 4/2009 | Grela | A47B 47/02 312/294 |
| 2014/0097731 | A1 * | 4/2014 | Grela | B25H 3/00 312/237 |
| 2014/0217879 | A1 * | 8/2014 | Kerner | F25D 25/02 312/408 |
| 2014/0230472 | A1 * | 8/2014 | Coradetti | F25D 29/008 62/125 |

(Continued)

FOREIGN PATENT DOCUMENTS

| | | |
|---|---|---|
| CN | 105870999 A | 8/2016 |
| CN | 206420230 U | 8/2017 |
| CN | 207247671 U | 4/2018 |

*Primary Examiner* — James O Hansen

(74) *Attorney, Agent, or Firm* — Dority & Manning, P.A.

(57) ABSTRACT

A refrigerator appliance having Universal Serial Bus (USB) features is provided. In one aspect, a refrigerator appliance has a cabinet defining a chamber. At least two shelf mounting tracks are disposed within chamber. A shelf having a USB port is mountable to the shelf tracks. The shelf tracks each include at least two bus bars. One bus bar is charged with a power charge, one is charged with a ground charge, one is charged with a positive data charge, and one is charged with a negative data charge. When the shelf is mounted to the tracks, the bus bars are in electrical communication with the USB port of the shelf such that data transmissions can be routed between the USB port and a controller or some other processing device. In another aspect, a refrigerator appliance includes features for enabling USB data transmissions to a bin mounted in a door thereof.

13 Claims, 17 Drawing Sheets

(56) References Cited

U.S. PATENT DOCUMENTS

| | | | | |
|---|---|---|---|---|
| 2014/0349502 | A1* | 11/2014 | Meis | H01R 25/16<br>439/212 |
| 2016/0341467 | A1 | 11/2016 | Mitchell et al. | |
| 2016/0341470 | A1* | 11/2016 | Brown | F25D 27/00 |
| 2017/0299257 | A1 | 10/2017 | Wantland et al. | |

* cited by examiner

REFRIGERATOR APPLIANCE HAVING USB FEATURES

FIELD OF THE INVENTION

The present subject matter relates generally to refrigerator appliances, and more particularly to refrigerator appliances having Universal Serial Bus (USB) features.

BACKGROUND OF THE INVENTION

Refrigerator appliances generally include a cabinet that defines a chilled chamber for receipt of food articles for storage. Refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

Consumers of refrigerator appliances generally enjoy connecting USB devices to their refrigerator appliances, including for example, USB cameras for viewing the contents within a chilled chamber, Ethylene sensors for detecting food freshness, and/or bar code scanners for maintaining food inventory or making automatic food orders online. USB ports can be located within a chilled chamber in a number of positions. Conventionally, it has been challenging to enable USB functionality to USB ports positioned on shelves, particularly adjustable shelves. Consumers have had to make electrical connections manually, which some consumers find inconvenient. Furthermore, it has been challenging to enable USB functionality to USB ports positioned on bins, particularly those located within a door of the refrigerator appliance.

Accordingly, a refrigerator appliance having USB features that addresses one or more of the challenges above would be useful.

BRIEF DESCRIPTION OF THE INVENTION

Aspects and advantages of the invention will be set forth in part in the following description, or may be obvious from the description, or may be learned through practice of the invention.

In one aspect, an appliance is provided. The appliance includes a cabinet defining a chamber. The appliance also includes a door coupled to the cabinet to provide selective access to the chamber. Further, the appliance includes a first track disposed within the chamber of the cabinet. The first track includes a first bus bar electrically charged with at least one of a power charge, a ground charge, a positive data charge, and a negative data charge. Moreover, the first track includes a second bus bar electrically isolated from the first bus bar and electrically charged with at least one of the power charge, the ground charge, the positive data charge, and the negative data charge. The appliance also includes a second track disposed within the chamber of the cabinet and spaced from the first track. The second track includes a first bus bar electrically charged with at least one of the power charge, the ground charge, the positive data charge, and the negative data charge. Moreover, the second track includes a second bus bar electrically isolated from the first bus bar of the second track, the second bus bar of the second track being electrically charged with at least one of the power charge, the ground charge, the positive data charge, and the negative data charge. In addition, the appliance includes a shelf having a universal serial bus port and mounted to the first track and the second track such that the first bus bar and the second bus bar of the first track and the first bus bar and the second bus bar of the second track are in electrical communication with the universal serial bus port.

In another aspect, an appliance is provided. The appliance includes a cabinet defining a chamber. The appliance also includes a door coupled with the cabinet to provide selective access to the chamber. Further, the appliance includes a track disposed on the door and having a connector, the connector having a plurality of plates, at least one of the plurality of plates being charged with a power charge, at least one of the plurality of plates being charged with a ground charge, at least one of the plurality of plates being charged with a positive data charge, and at least one of the plurality of plates being charged with a negative data charge. Moreover, the appliance includes a storage bin having a universal serial bus port and a plurality of electrical contacts. When the storage bin is mounted to the door and each of the plurality of electrical contacts of the storage bin engage a respective one of the plurality of plates of the track, the plurality of plates of the track are in electrical communication with the universal serial bus port of the storage bin.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
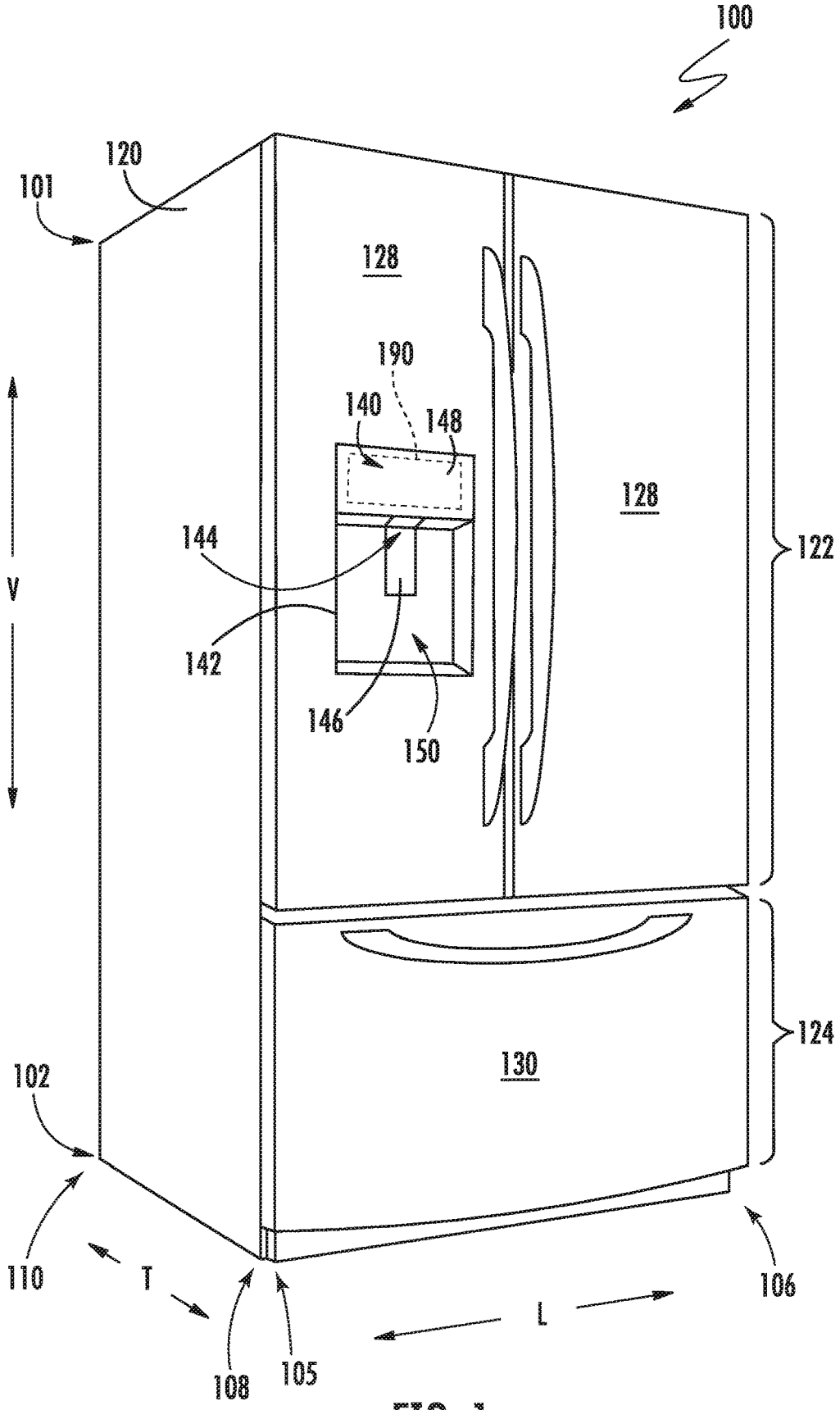
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. Furthermore, as used herein, terms of approximation, such as "approximately," "substantially," or "about," refer to being within a fifteen percent (15%) margin of error from the stated value.

FIG. 1 provides a perspective view of a refrigerator appliance 100 according to an exemplary embodiment of the present subject matter. Refrigerator appliance 100 includes a housing or cabinet 120. Cabinet 120 extends between a top 101 and a bottom 102 along a vertical direction V. Refrigerator appliance 100 also extends between a first side 105 and a second side 106 along a lateral direction L. For this embodiment, first side 105 corresponds with a left side of refrigerator appliance 100 and second side 106 corresponds with a right side of refrigerator appliance 100. Moreover, cabinet 120 extends between a front 108 and a back 110 along the transverse direction T. The vertical direction V, lateral direction L, and transverse direction T are mutually perpendicular and form an orthogonal direction system.

Cabinet 120 defines chilled chambers for receipt of food items for storage. In particular, cabinet 120 defines a fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the inventive aspects of the present disclosure apply to other types and styles of refrigerator appliances such as, e.g., a top mount refrigerator appliance or a side-by-side style refrigerator appliance. Consequently, the description set forth herein is for example purposes only and is not intended to be limiting in any aspect to any particular refrigerator appliance configuration. Furthermore, the inventive aspects of the present disclosure are applicable to other types of appliances, including other appliances in which items are stored.

Refrigerator doors 128 are rotatably hinged to an edge of cabinet 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration or position in FIG. 1 and in an open configuration or position in FIG. 2.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 allows a user to select modes of operation of refrigeration appliance 100. For example, control panel 148 can include a plurality of user inputs (not labeled), such as a water-dispensing button and an ice-dispensing button, which can allow for selection between crushed and non-crushed ice. Discharging outlet 144 and actuating mechanism 146 are an external part of dispenser 142 and are mounted in a dispenser recess 150 defined by left refrigerator door 128 as depicted in FIG. 1. Dispenser recess 150 is positioned at a predetermined elevation convenient for a user to access ice and/or water and without the need to open refrigerator doors 128.

Operation of the refrigerator appliance 100 can be regulated by a controller 190 that is communicatively coupled to control panel 148 and/or various operational components of refrigerator appliance 100. As noted above, control panel 148 provides selections for user manipulation of the operation of refrigerator appliance 100 such as e.g., selections between whole or crushed ice, chilled water, and other various options. In response to user manipulation of control panel 148, controller 190 may operate various components of refrigerator appliance 100.

Controller 190 can include one or more memory devices and one or more processing devices. The one or more memory devices can include a non-transitory computer readable media, FLASH, RAM, ROM, or electrically erasable, programmable read only memory (EEPROM). The one or more processing devices can include one or more microprocessors, CPUs or the like, such as general or special purpose microprocessors operable to execute programming instructions or micro-control code associated with operation of refrigerator appliance 100. In some embodiments, the processor executes programming instructions stored in memory. For example, the instructions may be software or any set of instructions that when executed by the processing device, cause the processing device to perform operations. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiment of FIG. 1, controller 190 is located behind or proximate control panel 140. In other embodiments, controller 190 may be positioned at any suitable location within refrigerator appliance 100, such as for example within a fresh food chamber, a freezer door, etc. Input/output ("I/O") signals may be routed between controller 190 and various operational components of refrigerator appliance 100. For example, control panel 140 may be in communication with controller 190 via one or more signal lines or shared communication busses.

Figure 2:
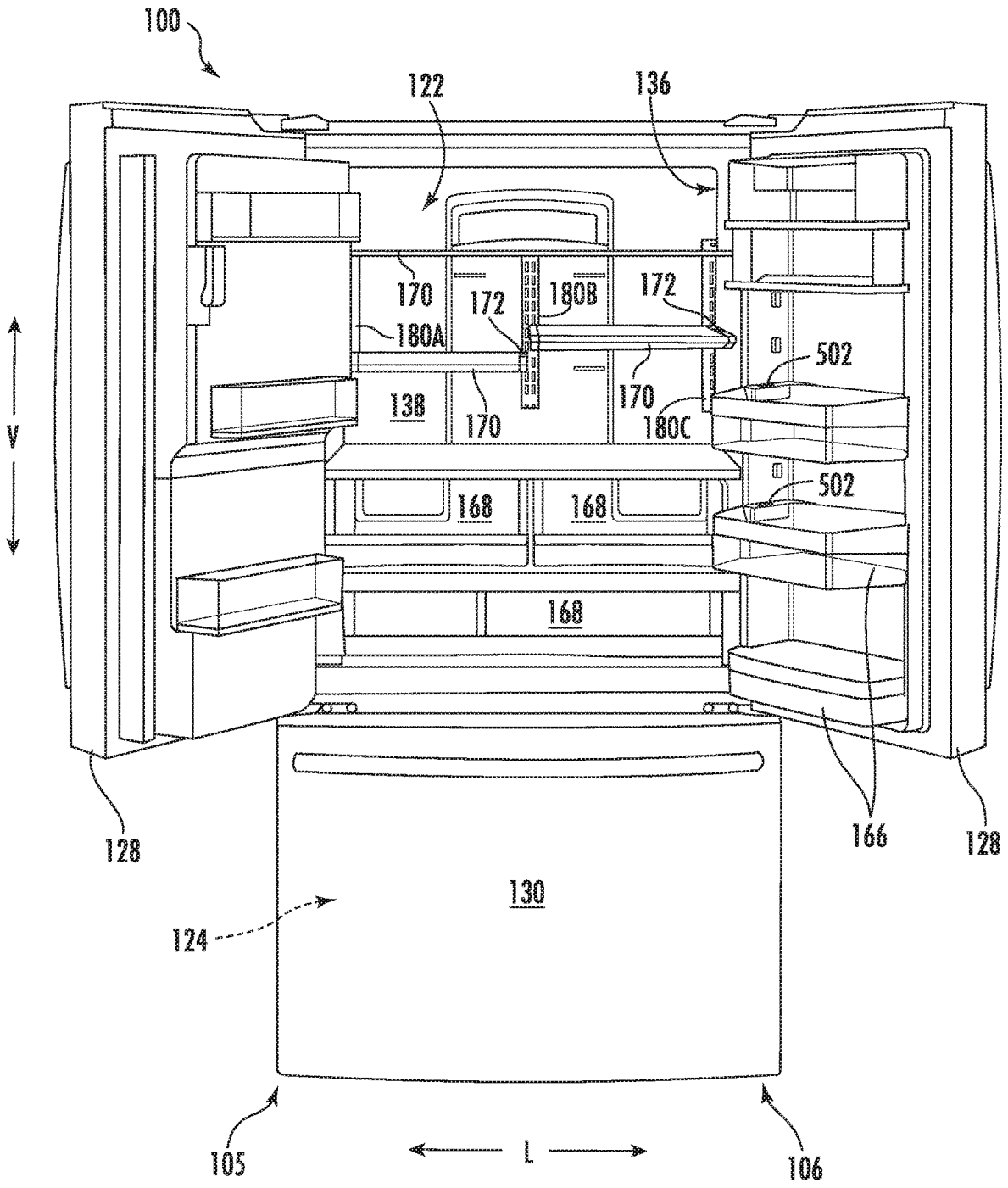
FIG. 2 provides a front view of the refrigerator appliance of FIG. 1 with refrigerator doors of the refrigerator appliance shown in an open position to reveal a fresh food chamber of the refrigerator appliance.

FIG. 2 provides a front view of refrigerator appliance 100 having refrigerator doors 128 in an open position to reveal the interior of fresh food chamber 122. Additionally, freezer door 130 is shown in an open position to reveal the interior of freezer chamber 124. As depicted, various storage components are mounted within fresh food chamber 122 to facilitate storage of food items therein as will be understood by those skilled in the art. In particular, the storage components include storage bins 166, drawers 168, and shelves 170 that are mounted within fresh food chamber 122. Storage bins 166, drawers 168, and shelves 170 are configured for receipt of food items (e.g., beverages and/or solid food items) and may assist with organizing such food items. As an example, drawers 168 can receive fresh food items (e.g., vegetables, fruits, and/or cheeses) and increase the useful life of such fresh food items.

For this embodiment, fresh food chamber 122 of refrigerator appliance 100 includes various shelf tracks to which one or more shelves 170 can be mounted. For this embodiment, refrigerator appliance 100 includes a left hand track 180A, a middle track 180B, and a right hand track 180C. The tracks 180A, 180B, 180C are mounted to a rear wall 138 of cabinet 120. The tracks 180A, 180B, 180C are oriented generally along the vertical direction V. Left hand track 180A is positioned at or proximate the first side 105 and right hand track 180C is positioned at or proximate second side 106 of refrigerator appliance 100. Middle track 180B is positioned between the tracks 180, 184 along the lateral direction L as shown (e.g., in the middle between tracks 180, 184). In alternative embodiments, tracks 180A, 180B, 180C can be mounted to another surface within the interior of cabinet 120, such as to one of the sidewalls 136 of cabinet 120 or along a surface in freezer chamber 124.

Notably, some or all of the shelf tracks 180A, 180B, 180C of refrigerator appliance 100 can enable transmission of digital data between controller 190 and a Universal Serial Bus (USB) device (not shown) connected to a USB port 172 positioned on one of shelves 170 and can enable electrical power transmission to the connected USB device. For instance, for the present embodiment, left hand track 180A, middle track 180B, and right hand track 180C are all USB-enabled tracks in that they are operable to transmit electrical power and digital data between a USB device connected to USB port 172 and controller 190 and/or some other processing device of refrigerator appliance 100. Example USB devices can include, without limitation, USB connectable cameras, ethylene sensors, bar code scanners, load sensors, lights, etc.

In some embodiments, the shelves or shelf 170 having USB port 172 can be selectively positioned by a user in different shelf mounting positions within fresh food chamber 122. For instance, as shown best in FIG. 3, cabinet 120 defines a vertical centerline CL dividing refrigerator appliance 100 along the lateral direction L. As shown, vertical centerline CL is oriented midway between first side 105 and second side 106 of refrigerator appliance 100. For this embodiment, as noted above, middle track 180B is oriented substantially along vertical centerline CL. Left and right hand tracks 180, 184 are positioned proximate first side 105 and proximate second side 106 along the vertical direction V as shown. In this manner, one column of adjustable shelves can be mounted proximate the first side 105 of refrigerator appliance 100 and one column of adjustable shelves can be mounted proximate second side 106 of refrigerator appliance 100. For example, a left side shelf mounting bracket of an adjustable shelf can be mounted in one of the mounting openings 182B-L of middle track 180B and a right side shelf mounting bracket thereof can be mounted in a corresponding mounting opening 182A of left hand track 180A. As another example, a left side shelf mounting bracket of an adjustable shelf can be mounted in one of the mounting openings 182B-R of middle track 180B and a right side shelf mounting bracket thereof can be mounted in a corresponding mounting opening 182C of right hand track 180C. In other embodiments, the shelves or shelf 170 having USB port 172 can be fixed to one or more tracks 180A, 180B, 180C. It will be appreciated that one, some, or all of the shelves 170 can be configured with USB ports.

Figure 3:
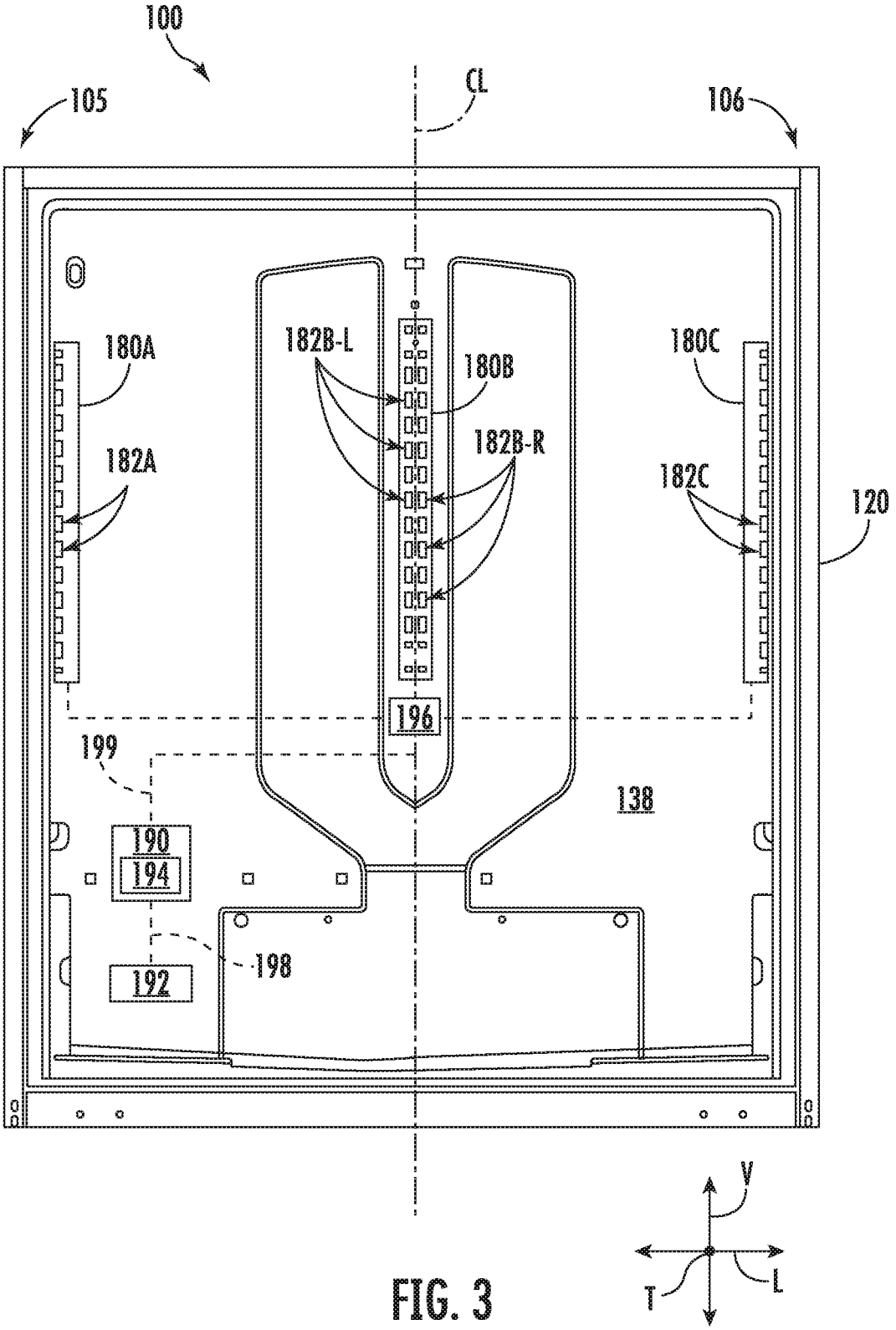
FIG. 3 provides a front schematic view of the refrigerator appliance of FIG. 1 with various components removed for illustrative purposes.

FIG. 3 provides a front schematic view of cabinet 120 of refrigerator appliance 100 with various components removed for illustrative purposes. As shown, tracks 180A, 180B, 180C are in electrical communication with a power source 192. For this embodiment, power source 192 is a power supply isolated from the line voltage supplying power to the main loads of refrigerator appliance 100, such as the compressor, motors, etc. Power source 192 can be a 12 volt (12V) or 24 volt (24V) power supply, for example. An electrical conduit 198 extends between power source 192 and controller 190. Controller 190 includes a power management unit 194 onboard or proximate controller 190. Power management unit 194 is operable to distribute electrical power received from power source 192 to tracks 180A, 180B, 180C as required, e.g., via a USB cable or conduit 199. Although power management unit 194 is shown positioned onboard controller 190, it will be appreciated that power management unit 194 can be positioned offboard controller 190 in other example embodiments.

Controller 190 is also communicatively coupled with a centralized hub 196. Centralized hub 196 can facilitate digital data exchange between a USB connected device and controller 190/power management unit 194. Centralized hub 196 is also communicatively coupled with each track 180A, 180B, 180C via USB conduit 199. USB conduit 199 can include a D+ wire and a D− wire carrying a differential or data signal, a power wire VCC (or VBUS), and a ground wire GND. The USB wires can be shielded or non-shielded wires. Furthermore, the USB cables of USB conduit 199 can include a drain wire and can be protected by one or more jackets.

Figure 4:
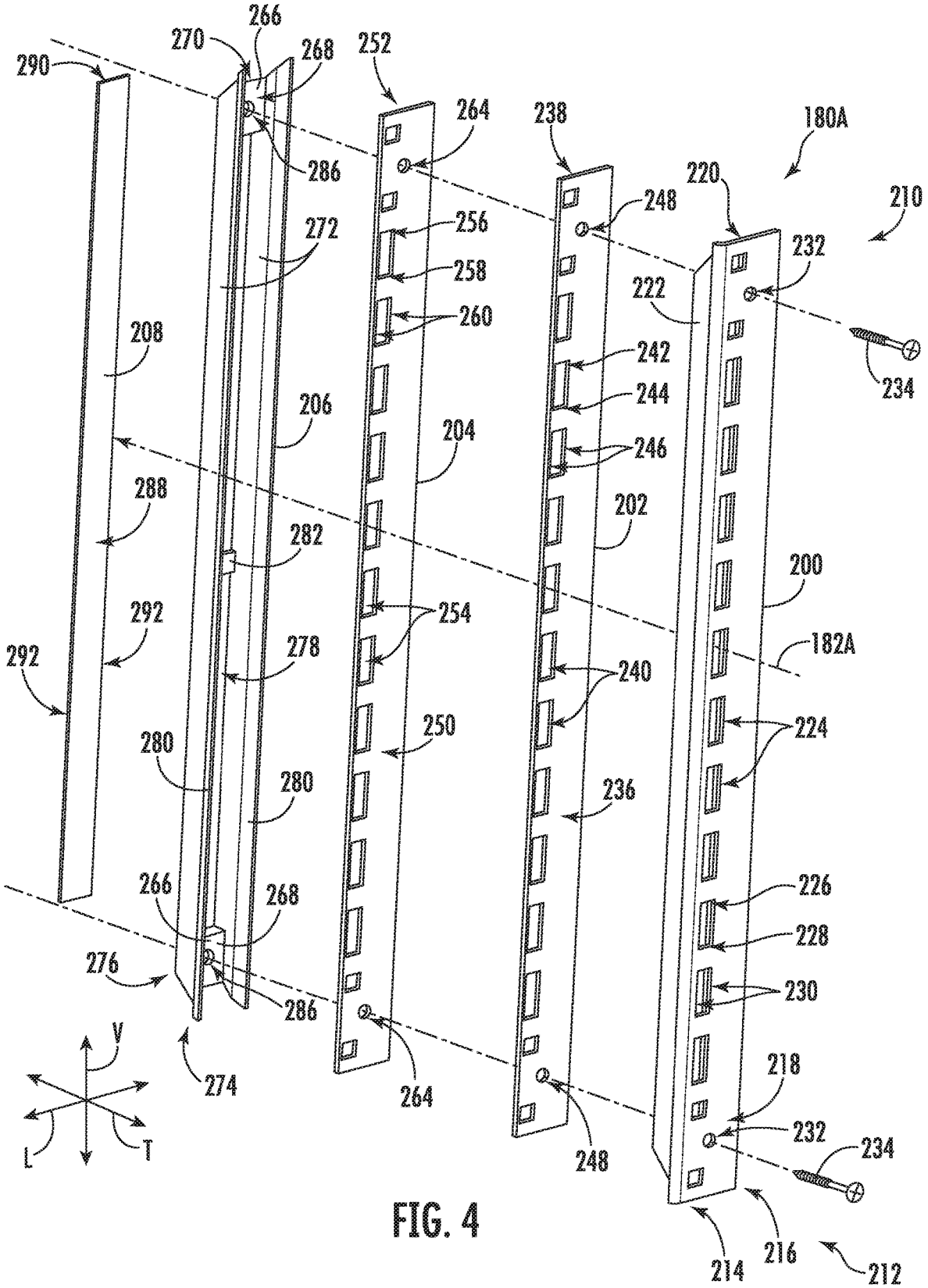
FIG. 4 provides an exploded view of a shelf mounting track of the refrigerator appliance of FIGS. 1 and 2 according to an exemplary embodiment of the present subject matter.
Figure 5:
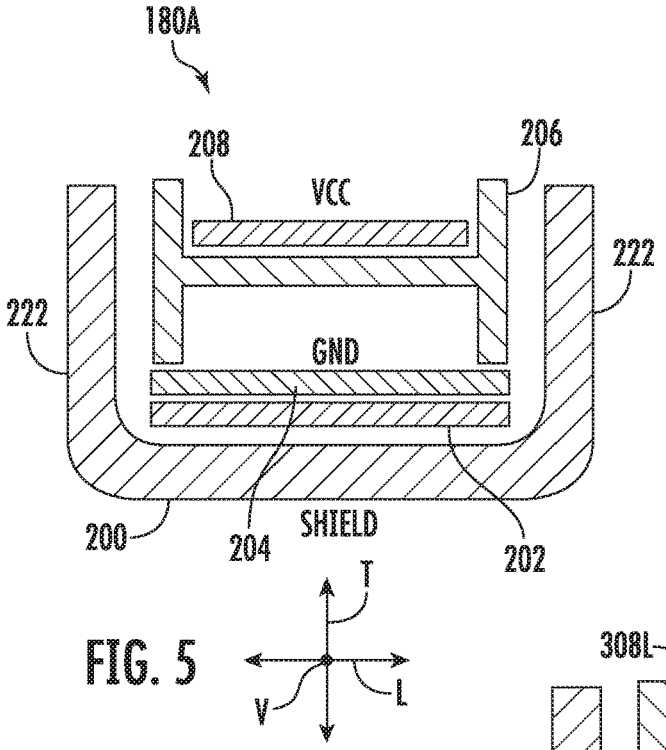
FIG. 5 provides a schematic top cross-sectional view of the track of FIG. 4.
Figure 6:
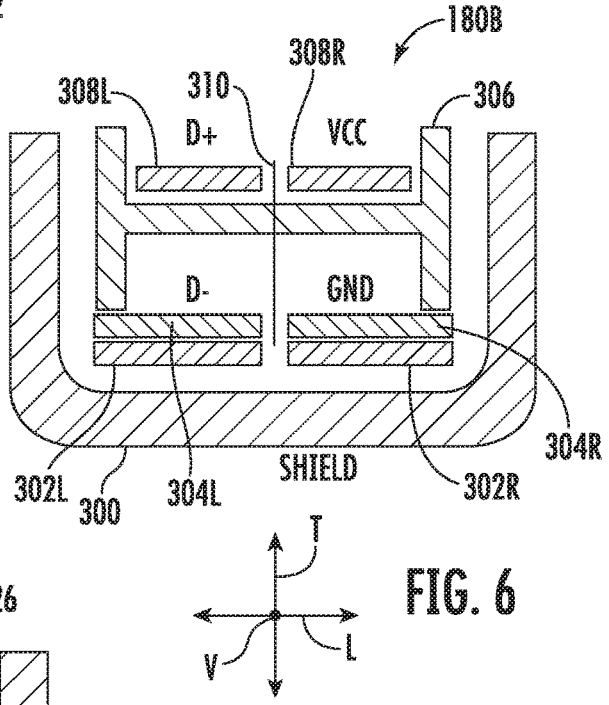
FIG. 6 provides a schematic top cross-sectional view of a middle track of the refrigerator appliance of FIGS. 1 and 2.
Figure 7:
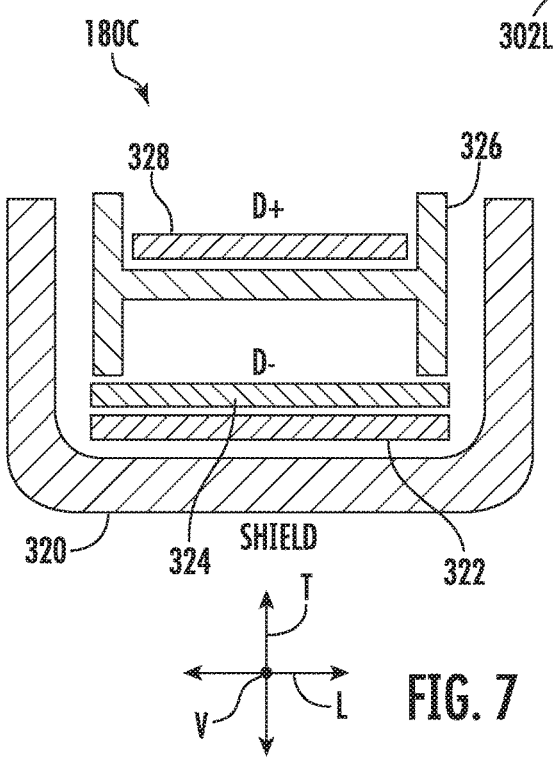
FIG. 7 provides a schematic top cross-sectional view of a right hand track refrigerator appliance of FIGS. 1 and 2.

FIGS. 4, 5, 6, and 7 provide various views of the shelf tracks 180A, 180B, 180C. Particularly, FIG. 4 provides an exploded view of left hand track 180A according to an exemplary embodiment of the present subject matter. FIG. 5 provides a schematic top cross-sectional view of left hand track 180A. FIG. 6 provides a schematic top cross-sectional view of middle track 180B. FIG. 7 provides a schematic top cross-sectional view of right hand track 180C. Generally, left hand track 180A and right hand track 180C are similarly configured, except as noted below. Middle track 180B is also similarly configured, except that it includes a left hand side and a right hand side as will be explained below.

As shown in FIG. 4, from front to back along the transverse direction T, left hand track 180A includes a first support member 200, an insulating member 202, a first bus bar 204, a second support member 206, and a second bus bar 208. Each component will be discussed in turn.

First support member 200 structurally supports one or more shelves 170 (FIG. 2) when they are mounted to left hand track 180A. Moreover, first support member 200 structurally supports the weight of the other components of left hand track 180A. First support member 200 can be made of any suitable structural material. For example, in this embodiment, first support member is made of steel. First support member 200 extends along the vertical direction V between a top portion 210 and a bottom portion 212 of left hand track 180A. First support member 200 also extends in the lateral direction L between a first side portion 214 and a second side portion 216 of left hand track 180A. First support member 200 includes a front surface 218 and a rear surface 220, both of which are substantially coplanar with a plane including both the vertical direction V and the lateral direction L. That is, front surface 218 and rear surface 220 are substantially orthogonal to the transverse direction T.

Sidewalls 222 of first support member 200 extend from rear surface 220 generally along the transverse direction T in a rearward direction. One sidewall 222 extends in the transverse direction T from the first side portion 214 of rear surface 220 and one sidewall 222 (not visible in FIG. 4; see FIG. 5) extends in the transverse direction T from second side portion 216 of rear surface 220. In some embodiments, at least a portion of each sidewall 222 may be angled with respect to the transverse direction T. For this embodiment, the sidewalls 222 of first support member 200 are angled inward toward one another as they extend generally rearward along the transverse direction T. In alternative exemplary embodiments, sidewalls 222 can extend substantially along the transverse direction T from rear surface 220 from their respective first and second side portions 214, 216.

First support member 200 defines a plurality of apertures 224 extending between front surface 218 and rear surface 220. Each aperture 224 is shown in a generally rectangular configuration; however, other suitable configurations are contemplated, such as square configurations. Each aperture 224 includes a top edge 226, a bottom edge 228, and two side edges 230 oriented parallel to one another and perpendicular to the top and bottom edges 226, 228. Apertures 224 form a part of mounting openings 182A (FIG. 3).

First support member 200 also defines one or more fastener apertures 232 extending between front surface 218 and rear surface 220 along the transverse direction T. Fastener apertures 232 receive mechanical fasteners 234, such as screws, for securing left hand track 180A with cabinet 120 of refrigerator appliance 100 (FIG. 2). As shown, one fastener aperture 232 is located proximate top portion 210 of left hand track 180A and one fastener aperture 232 is located proximate bottom portion 212. Fastener apertures 232 can be any suitable shape or configuration. For this embodiment, fastener apertures 232 are shown in a generally circular configuration.

As noted above, first support member 200 is formed of an electrically conductive material. Thus, in some embodiments, first support member 200 can function as a shielding element of left hand track 180A, as denoted by SHIELD in FIG. 5. As first support member 200 functions as a shielding element, the effects of electromagnetic disturbances can be limited and USB devices connected to USB port 172 can be protected from external disturbances, such as transient bursts induced in USB conduit 199 (FIG. 3). In some embodiments, first support member 200 is connected to an electrical ground and is in electrical communication with USB port 172, e.g., via a wire.

Insulating member 202 is formed of an electrically insulating material and is positioned between first support member 200 and first bus bar 204, e.g., along the transverse direction T. Thus, insulating member 202 separates first support member 200 and first bus bar 204. In this way, first support member 200 and first bus bar 204 are electrically isolated from one another. Insulating member 202 extends along the vertical direction V between top portion 210 and bottom portion 212 of left hand track 180A. Insulating member 202 also extends along the lateral direction L between first side portion 214 and second side portion 216. Insulating member 202 has a thickness along the transverse direction T. Insulating member 202 includes a front surface 236 and a rear surface 238, both of which are substantially coplanar with a plane including both the vertical direction V and the lateral direction L. When coupled, front surface 236 of insulating member 202 sits flush against rear surface 220 of first support member 200. In some exemplary embodiments, however, front surface 236 of insulating member 202 need not sit flush with rear surface 220 of first support member 200 (i.e., insulating member 202 may be spaced from first support member 200 along the transverse direction T in some embodiments).

Similar to first support member 200, insulating member 202 defines a plurality of apertures 240 extending between front surface 236 and rear surface 238. Each aperture 240 of insulating member 202 is shown in a generally rectangular configuration; however, other suitable configurations are contemplated. Each aperture 240 includes a top edge 242, a bottom edge 244, and two side edges 246 oriented parallel to one another and perpendicular to top and bottom edges 242, 244. When left hand track 180A is assembled, each aperture 240 of insulating member 202 is in communication with a corresponding aperture 224 of first support member 200. Apertures 224, 240 of first support member 200 and insulating member 202 are each configured to receive at least a portion of one of shelves 170 (e.g., a mounting bracket thereof) when the shelf 170 is mounted to left hand track 180A. In this way, like apertures 224 of first support member 200, apertures 240 form a part of mounting openings 182A.

In addition, like first support member 200, insulating member 202 defines one or more fastener apertures 248 extending between front surface 236 and rear surface 238 of insulating member 202. As shown, one fastener aperture 248 is located proximate top portion 210 of left hand track 180A and one fastener aperture 248 is located proximate bottom portion 212. When left hand track 180A is assembled, each fastener aperture 248 of insulating member 202 is in communication with a corresponding fastener aperture 232 of first support member 200. In this regard, fastener apertures 232, 248 of first support member 200 and insulating member 202 receive mechanical fasteners 234 for securing left hand track 180A with cabinet 120 of refrigerator appliance 100 (FIG. 2).

First bus bar 204 is an electrically conductive component and is communicatively coupled with centralized hub 196 via USB conduit 199, which is in turn communicatively coupled with controller 190. For this embodiment, first bus bar 204 is communicatively coupled, or more specifically in electrical communication, with centralized hub 196 via a ground wire of USB conduit 199, and thus, first bus bar 204 is electrically charged or designated as the ground GND of left hand track 180A as depicted in FIG. 5. First bus bar 204 can be any suitable electrically conducting material, such as stainless steel, for example. First bus bar 204 extends in the vertical direction V between top portion 210 and bottom portion 212 of left hand track 180A. First bus bar 204 also extends in the lateral direction L between first side portion 214 and second side portion 216. First bus bar 204 has a thickness along the transverse direction T. First bus bar 204 includes a front surface 250 and a rear surface 252, both of which are substantially coplanar with a plane including both vertical direction V and lateral direction L. When coupled, front surface 250 of first bus bar 204 sits flush against rear surface 238 of insulating member 202. In some exemplary embodiments, however, front surface 250 of first bus bar 204 need not sit flush with rear surface 238 of insulating member 202 (i.e., first bus bar 204 may be spaced from insulating member 202 along the transverse direction T).

Like first support member 200 and insulating member 202, first bus bar 204 defines a plurality of apertures 254 extending between front surface 250 and rear surface 252. Each aperture 254 of first bus bar 204 is shown in a generally rectangular configuration; however, other suitable configurations are contemplated. Each aperture 254 includes a top edge 256, a bottom edge 258, and two side edges 260 oriented parallel to one another and perpendicular to top and bottom edges 256, 258. When left hand track 180A is assembled, each aperture 254 of first bus bar 204 is in communication with a corresponding aperture 224 of first support member 200 and aperture 240 of insulating member 202. Apertures 224, 240, 254 of first support member 200, insulating member 202, and first bus bar 204 are each configured to receive at least a portion of shelf 170 when shelf 170 is mounted to left hand track 180A. In this way, like apertures 224, 240 of first support member 200 and insulating member 202, respectively, apertures 254 of first bus bar 204 form a part of mounting openings 182A.

In addition, like first support member 200 and insulating member 202, first bus bar 204 defines one or more fastener apertures 264 extending between front surface 250 and rear surface 252 of first bus bar 204. As shown, one fastener aperture 264 is located proximate top portion 210 of left hand track 180A and one fastener aperture 264 is located proximate bottom portion 212. When left hand track 180A is assembled, each fastener aperture 264 of first bus bar 204 is in communication with a corresponding fastener aperture 232 of first support member 200 and fastener aperture 248 of insulating member 202. In this regard, fastener apertures 232, 248, 264 of first support member 200, insulating member 202, and first bus bar 204 receive mechanical fasteners 234 for securing left hand track 180A with cabinet 120 of refrigerator appliance 100 (FIG. 2).

Referring still to FIG. 4, second support member 206 extends in the vertical direction V between top portion 210 and bottom portion 212 of left hand track 180A. Second support member 206 also extends in the lateral direction L between first side portion 214 and second side portion 216. Second support member 206 can be made of any suitable material, such as plastic. In some embodiments, second support member 206 is formed of a non-electrically conductive or insulating material.

Second support member 206 includes lateral members 266, one of which is located proximate top portion 210 and one is located proximate bottom portion 212 of left hand track 180A. Lateral members 266 both include a front surface 268 and a rear surface 270, both of which are substantially planar with the lateral direction L. Lateral members 266 extend in the lateral direction L between opposed transverse members 272. Each transverse member 272 extends in the transverse direction T between a front portion 274 and a rear portion 276 of second support member 206 and each transverse member 272 extends in the vertical direction V between top portion 210 and bottom portion 212 of left hand track 180A. Lateral members 266 and transverse members 272 define a gap 278. Gap 278, along with apertures 224, 240, 254 of first support member 200, insulating member 202, and first bus bar 204, form a part of mounting openings 180A. As shown by the dashed line denoted with 180A in FIG. 4, shelf 170 (FIG. 2) or portions thereof can be inserted through apertures 224, 240, 254 and into gap 278 (collectively "mounting openings 180A") to secure shelf 170 to left hand track 180A.

Extending from front portion 230 of each transverse member 272 are sidewalls 280. Sidewalls 280 extend substantially in the transverse direction T from transverse members 272 in a forward direction toward first support member 200. As depicted, sidewalls 280 may be angled with respect to the transverse direction T. In this embodiment, sidewalls 280 of second support member 206 are angled outward with respect to one another as they extend generally forward along the transverse direction T. When left hand track 180A is assembled, sidewalls 280 of second support member 206 mate with sidewalls 222 of first support member 200. In this regard, the angled sidewalls 280 of second support member 206 are complementary to sidewalls 222 of first support member 200. In other alternative exemplary embodiments, sidewalls 280 can be configured to extend substantially along the transverse direction T in the forward direction.

Figure 8:
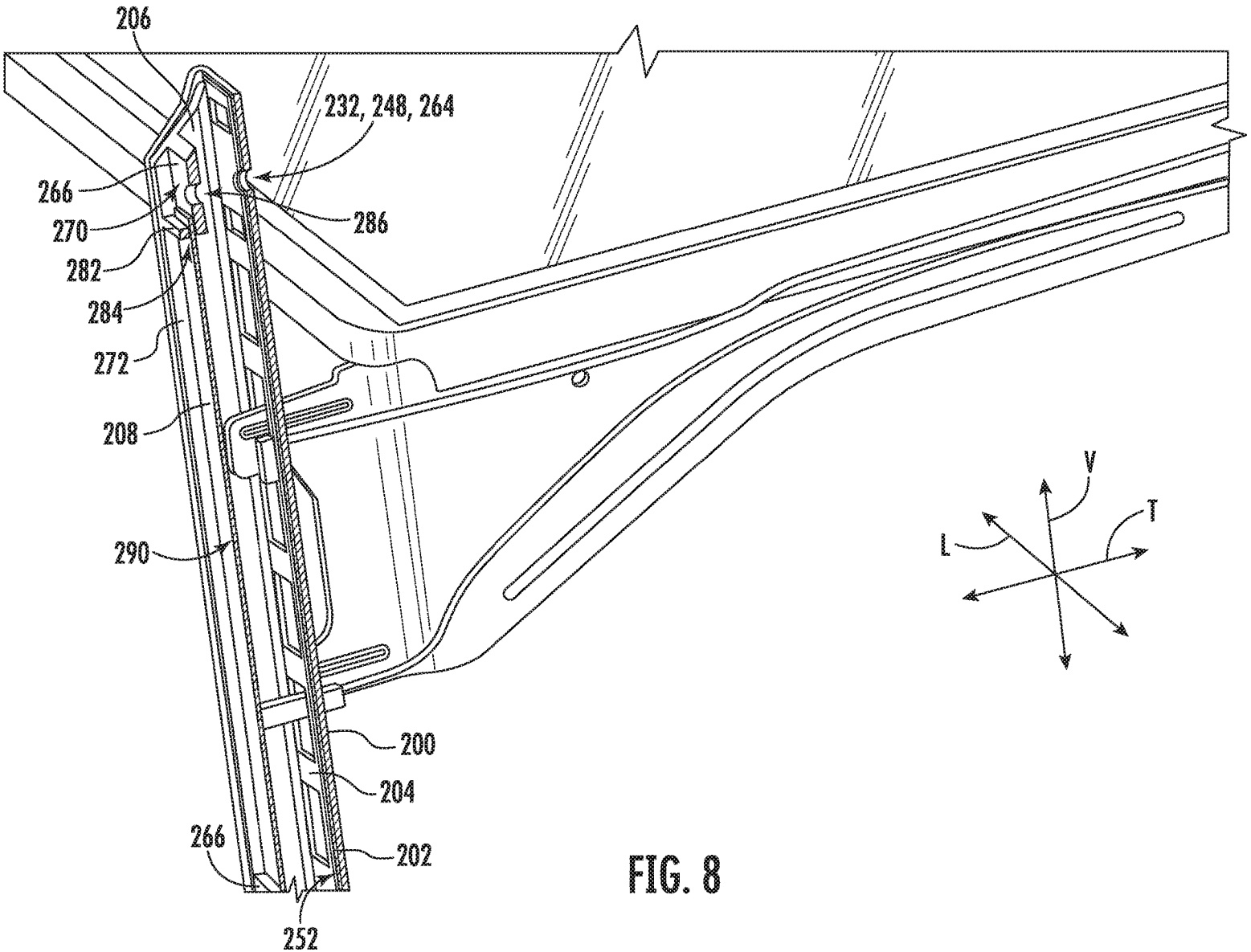
FIG. 8 provides a perspective, cutaway view of the left hand track of FIGS. 4 and 5 with a shelf mounted thereto according to an exemplary embodiment of the present subject matter.

With reference now to FIGS. 4 and 8, FIG. 8 provides a perspective, cutaway view of left hand track 180A of FIG. 4 with shelf 170 mounted thereto according to an exemplary embodiment of the present subject matter. As shown in FIGS. 4 and 8, one or more retention members 282 extend in the lateral direction L between opposed transverse members 272. With specific reference to FIG. 4, one retention member 282 is shown positioned approximately midway between top portion 210 and bottom portion 212 of left hand track 180A. In addition, with specific reference to FIG. 8, retention members 282 can also be positioned proximate top portion 210. Although not shown, retention members 282 can be positioned proximate bottom portion 212. Retention members 282 positioned proximate top and bottom portion 210, 212 are spaced from the lateral members 266 in the transverse direction T. Specifically, retention members 282 are spaced rearward of lateral members 266 in the transverse direction T. Retention members 282 can be positioned directly behind lateral members 266. In this way, lateral members 266 and retention members 282 define slits 284 in which second bus bar 208 is coupled with second support member 206.

More particularly, for this embodiment, second bus bar 208 is coupled with second support member 206 by sliding second bus bar 208 into slits 284 of second support member 206. For example, second bus bar 208 can be press or friction fit into slits 284. It will be appreciated, however, that second bus bar 208 can be coupled with second support member 206 in any suitable manner. In addition, although not shown, second support member 206 can include channels extending along the vertical direction V on the inner side of the transverse members 272 for receiving side surfaces of second bus bar 208. This may further secure second bus bar 208 in place. In addition, as shown in FIG. 8, second bus bar 208 is spaced apart from first bus bar 204 along the transverse direction T. Specifically, second bus bar 208 is spaced rearward of first bus bar 204 along the transverse direction T. Second bus bar 208 is also electrically isolated from first support member 200 as well.

Referring again to FIG. 4, like first support member 200, insulating member 202, and first bus bar 204, second support member 206 defines one or more fastener apertures 286 extending between front surface 268 and rear surface 270 of lateral members 266 of second support member 206. As shown, one aperture 286 is located proximate top portion 210 of left hand track 180A and one aperture 286 is located proximate bottom portion 212. When left hand track 180A is assembled, each fastener aperture 286 of second support member 206 is in communication with a corresponding fastener apertures 232, 248, 264 of first support member 200, insulating member 202, and first bus bar 204, respectively. In this way, apertures 232, 248, 264 receive mechanical fasteners 234 for securing left hand track 180A with cabinet 120 of refrigerator appliance 100 (FIG. 2).

Second bus bar 208, like first bus bar 204, is formed of an electrically conductive material and is communicatively coupled with centralized hub 196 via USB conduit 199, which is in turn communicatively coupled with controller 190. For this embodiment, second bus bar 208 is communicatively coupled, or more specifically in electrical communication, with centralized hub 196 via a power wire of USB conduit 199, and thus, second bus bar 208 is electrically charged with the power charge VCC as depicted in FIG. 5. That is, a voltage is carried via the power wire of the USB conduit 199, and as the power wire is electrically connected to second bus bar 208, second bus bar 208 is charged with the power charge VCC by the voltage carried by the power wire.

Second bus bar 208 can be any suitable electrically conducting material, such as stainless steel, for example. Second bus bar 208 extends in the vertical direction V between top portion 200 and bottom portion 212 of left hand track 180A. Second bus bar 208 also extends in the lateral direction L between first side portion 214 and second side portion 216. Second bus bar 208 includes a front surface 288 and a rear surface 290, both of which are substantially planar with the lateral direction L, and two side surfaces 292 that are substantially planar with the transverse direction T and connect front and rear surfaces 288, 290 of second bus bar 208. As noted above, second bus bar 208 is coupled with second support member 206. Notably, first bus bar 204 and second bus bar 208 of left hand track 180A extend substantially between the top portion 210 and the bottom portion 212 of left hand track 180A. In this manner, when a shelf is mounted to left hand track 180A, the electrical connectors of the shelf can contact the bus bars 204, 208 at any shelf mounting position.

As shown in FIG. 6, middle track 180B is similarly configured as left hand track 180A depicted in FIGS. 4 and 5 and described in the accompanying text, except as provided below. For this embodiment, first bus bar and second bus bar of middle track 180B are split into distinct and electrically isolated bus bars. Moreover, for this embodiment, the insulating member is also split (although it need not be in some embodiments). Accordingly, from front to back along the transverse direction T, middle track 180B includes a first support member 300, a left insulating member 302L and a right insulating member 302R, a left first bus bar 304L and a right first bus bar 304R, a second support member 306, and a left second bus bar 308L and a right second bus bar 308R. Left first bus bar 304L is aligned with the left second bus bar 308L along the lateral direction L and is spaced from left second bus bar 308L along the transverse direction T. Indeed, second support member 306 is positioned between left first bus bar 304L and left second bus bar 308L along the transverse direction T. Right first bus bar 304R is aligned with right second bus bar 308R along the lateral direction L and is spaced from right second bus bar 308R along the transverse direction T. As shown, second support member 306 is positioned between right first bus bar 304R and right second bus bar 308R along the transverse direction T. Left first bus bar 304L and left second bus bar 308L form a first pair of bus bars and right first bus bar 304R and right second bus bar 308R form a second pair of bus bars.

In some embodiments, middle track 180B includes a divider 310, which is formed of a non-electrically conductive or insulating material and is operable to electrically isolate the electrically charged bus bars 304L, 308L of the left hand side of middle track 180B and electrically charged bus bars 304R, 308R of the right hand side of middle track 180B. That is, divider 310 is formed of an electrically insulating material and is positioned between the first pair of bus bars and the second pair of bus bars along the lateral direction L, wherein the first pair of bus bars includes left first bus bar 304L and left second bus bar 308L and the second pair of bus bars includes right first bus bar 304R and right second bus bar 308R.

As depicted in FIGS. 5 and 6, the left hand side of middle track 180B is associated with left hand track 180A. Particularly, left first bus bar 304L is communicatively coupled with centralized hub 196 via USB conduit 199 (FIG. 3), which is in turn communicatively coupled with controller 190. For this embodiment, left first bus bar 304L is communicatively coupled, or more specifically in electrical communication, with centralized hub 196 via a negative data wire of USB conduit 199, and thus, left first bus bar 304L is electrically charged with a negative data charge D− as depicted in FIG. 6. That is, a negative data signal is carried via the negative data wire of the USB conduit 199, and as the negative data wire is electrically connected to left first bus bar 304L, left first bus bar 304L is charged with a negative data charge D−.

Figure 9:
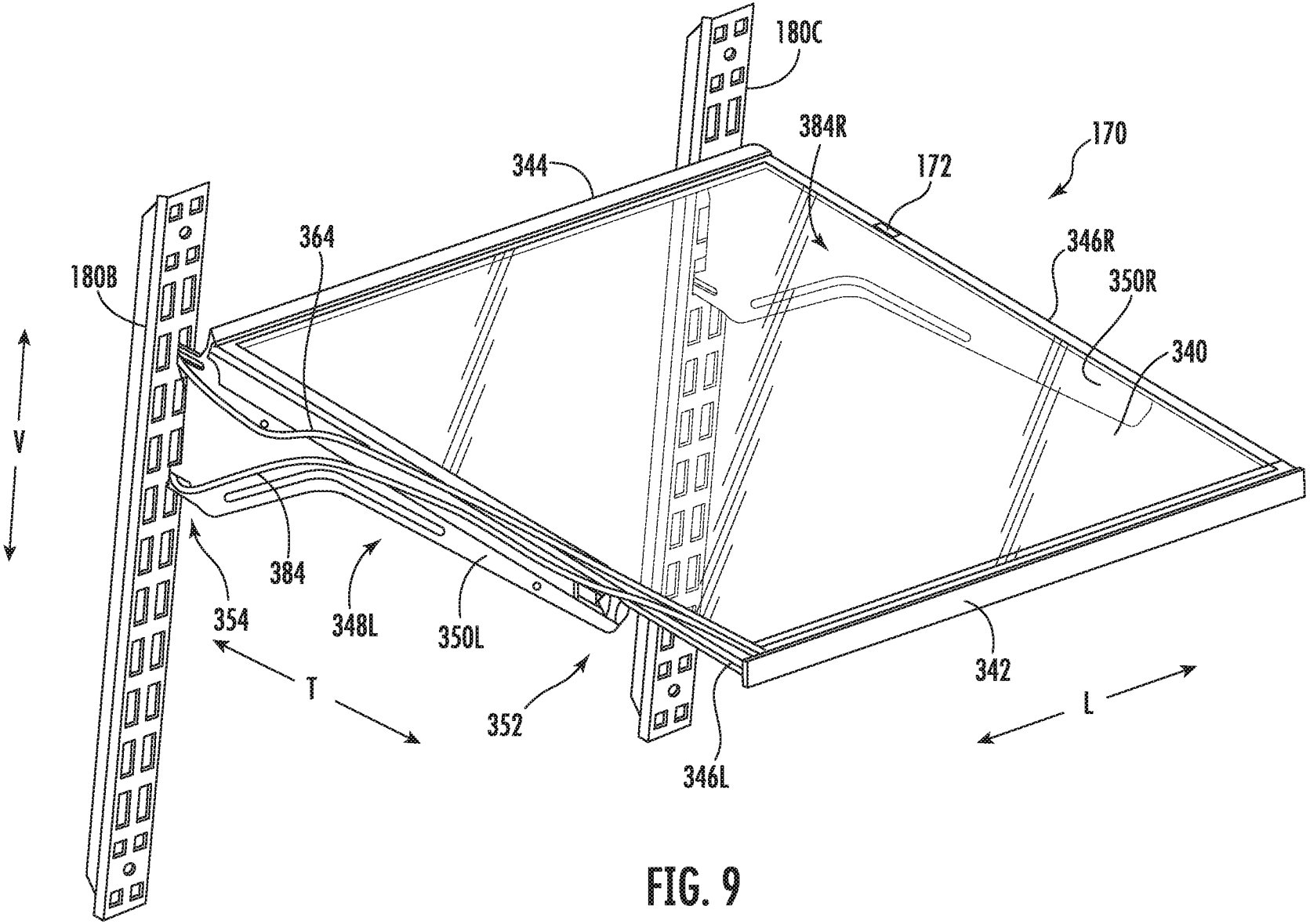
FIG. 9 provides a front perspective view of a shelf mounted to the middle track of FIG. 6 and the right hand track of FIG. 7.

Similarly, left second bus bar 308L is communicatively coupled with centralized hub 196 via USB conduit 199 (FIG. 3), which is in turn communicatively coupled with controller 190. For this embodiment, left second bus bar 308L is communicatively coupled, or more specifically in electrical communication, with centralized hub 196 via a positive data wire of USB conduit 199, and thus, left second bus bar 308L is electrically charged with a positive data charge D+ as depicted in FIG. 6. That is, a positive data signal is carried via the positive data wire of the USB conduit 199, and as the positive data wire is electrically connected to left second bus bar 308L, left second bus bar 308L is charged with positive data charge D+. Left first bus bar 304L and left second bus bar 308L collectively carry a differential signal to USB port 172 (FIG. 9). It will be appreciated that bus bars 202, 208, 304L, 308L can be electrically charged with the GND, VCC, D−, and D+ in any suitable arrangement or combination and that the bus bars 202, 208, 304L, 308L are charged in the manner in FIGS. 5 and 6 as an example of one manner in which the bus bars 202, 208, 304L, 308L can be electrically charged.

First support member 300 is formed of an electrically conductive material as noted above. Thus, in some embodiments, first support member 300 can function as a shielding element of middle track 180B, as denoted by SHIELD in FIG. 6. As first support member 300 functions as a shielding element, the effects of electromagnetic disturbances can be limited and USB devices connected to USB port 172 can be protected from external disturbances, such as transient bursts induced in USB conduit 199 (FIG. 3).

As shown in FIG. 7, right hand track 180C is similarly configured as left hand track 180A depicted in FIG. 5 and described in the accompanying text, except as provided below. From front to back along the transverse direction T, right hand track 180C includes a first support member 320, an insulating member 322, a first bus bar 324, a second support member 326, and a second bus bar 328. For this embodiment, first bus bar 324 is an electrically conductive component and is communicatively coupled with centralized hub 196 via USB conduit 199 (FIG. 3), which is in turn communicatively coupled with controller 190. For this embodiment, first bus bar 324 is communicatively coupled, or more specifically in electrical communication, with centralized hub 196 via a negative data wire of USB conduit 199, and thus, first bus bar 324 is electrically charged with a negative data charge D− as depicted in FIG. 7. That is, a negative data signal is carried via the negative data wire of the USB conduit 199, and as the negative data wire is electrically connected to first bus bar 324, first bus bar 324 is charged with a negative data charge D-. First bus bar 324 can be any suitable electrically conducting material, such as stainless steel.

Second bus bar 328 is an electrically conductive component and is communicatively coupled with centralized hub 196 via USB conduit 199 (FIG. 3), which is in turn communicatively coupled with controller 190. For this embodiment, second bus bar 328 is communicatively coupled, or more specifically in electrical communication, with centralized hub 196 via a positive data wire of USB conduit 199, and thus, second bus bar 328 is electrically charged with a positive data charge D+ as depicted in FIG. 7. That is, a positive data signal is carried via the positive data wire of the USB conduit 199, and as the positive data wire is electrically connected to second bus bar 328, second bus bar 328 is charged with positive data charge D+. Second bus bar 328 can be any suitable electrically conducting material, such as stainless steel. First bus bar 324 and second bus bar 328 collectively carry a differential signal to USB port 172 (FIG. 9).

First support member 320 is formed of an electrically conductive material as noted above. Thus, in some embodiments, first support member 320 can function as a shielding element of right hand track 180C, as denoted by SHIELD in FIG. 7. As first support member 320 functions as a shielding element, the effects of electromagnetic disturbances can be limited and USB devices connected to USB port 172 can be protected from external disturbances, such as transient bursts induced in USB conduit 199 (FIG. 3).

With reference now to FIGS. 6 and 7, as shown, the right hand side of middle track 180B is associated with right hand track 180C. Specifically, right first bus bar 304R is communicatively coupled with centralized hub 196 via USB conduit 199 (FIG. 3), which is in turn communicatively coupled with controller 190. For this embodiment, right first bus bar 304R is communicatively coupled, or more specifically in electrical communication, with centralized hub 196 via a ground wire of USB conduit 199, and thus, right first bus bar 304R is electrically charged or designated as GND of the right hand side of middle track 180B as depicted in FIG. 6.

In addition, right second bus bar 308R is communicatively coupled with centralized hub 196 via USB conduit 199 (FIG. 3), which is in turn communicatively coupled with controller 190. For this embodiment, right second bus bar 308R is communicatively coupled, or more specifically in electrical communication, with centralized hub 196 via a power wire of USB conduit 199, and thus, right second bus bar 308R is electrically charged with the power charge VCC as depicted in FIG. 6. That is, a voltage is carried via the power wire of the USB conduit 199, and as the power wire is electrically connected to right second bus bar 308R, right second bus bar 308R is charged with the power charge VCC by the voltage carried by the power wire. It will be appreciated that bus bars 304R, 308R, 324, 328 can be electrically charged with the GND, VCC, D−, and D+ in any suitable arrangement or combination and that the bus bars 304R, 308R, 324, 328 are charged in the manner in FIGS. 6 and 7 as an example of one manner in which the bus bars 304R, 308R, 324, 328 can be electrically charged.

Figure 10:
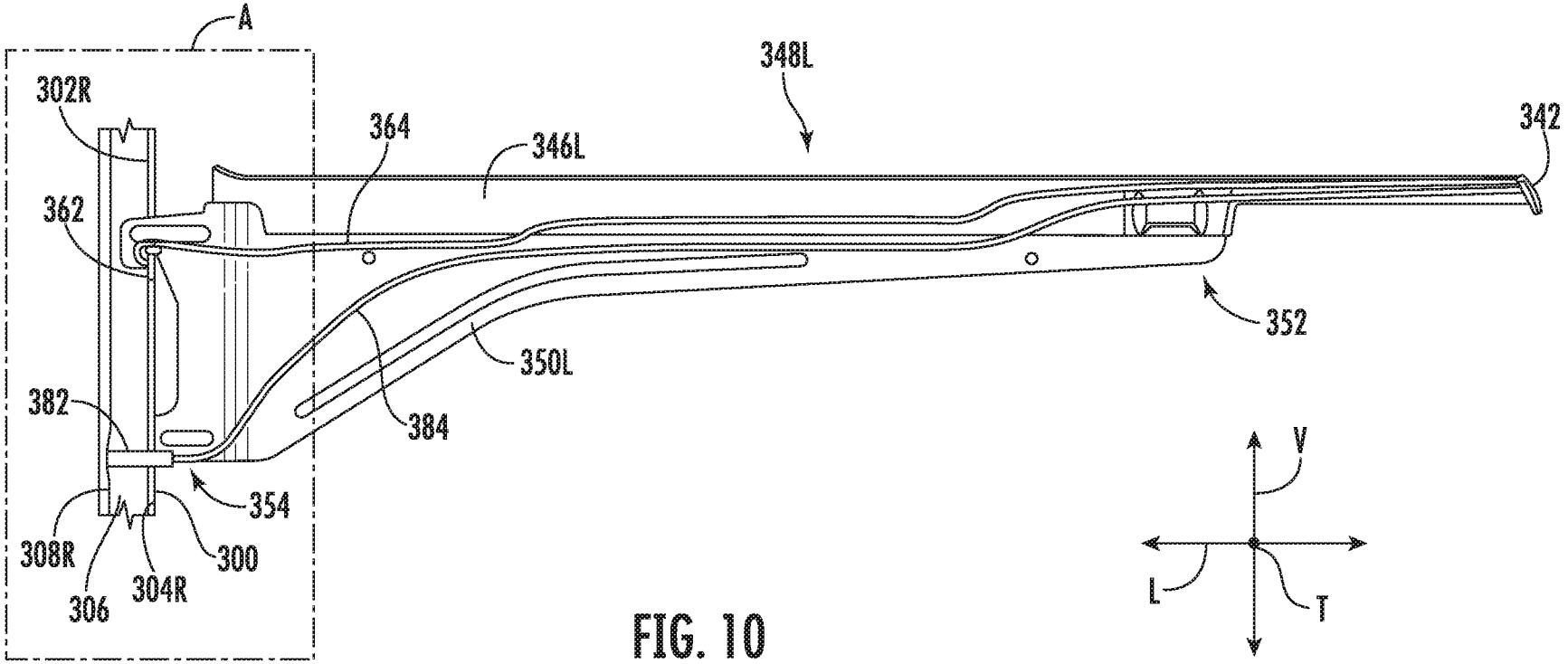
FIG. 10 provides a side view of the shelf of FIG. 9 mounted to the middle track.
Figure 11:
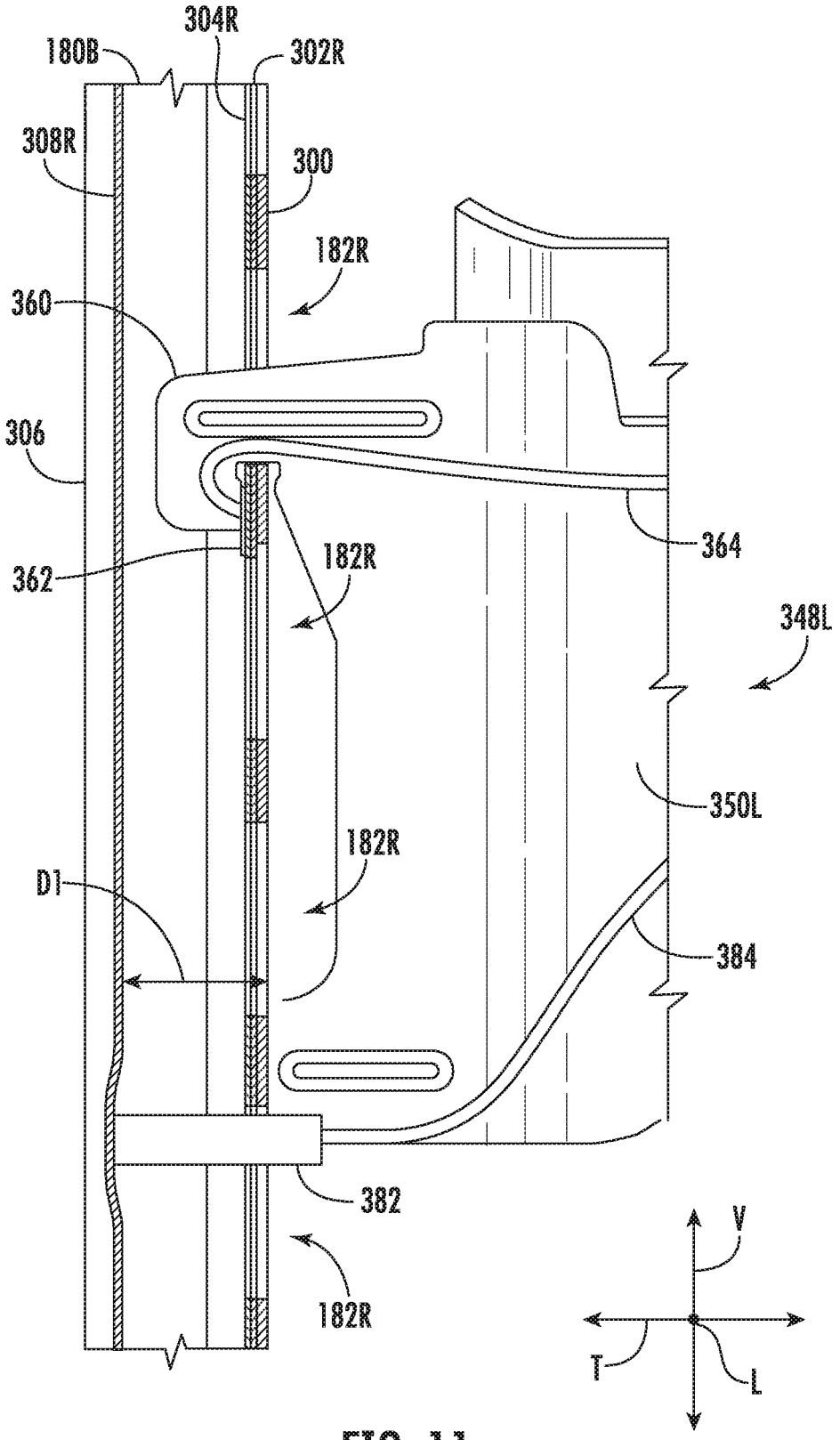
FIG. 11 provides a close-up view of Section A of FIG. 10.
Figure 12:
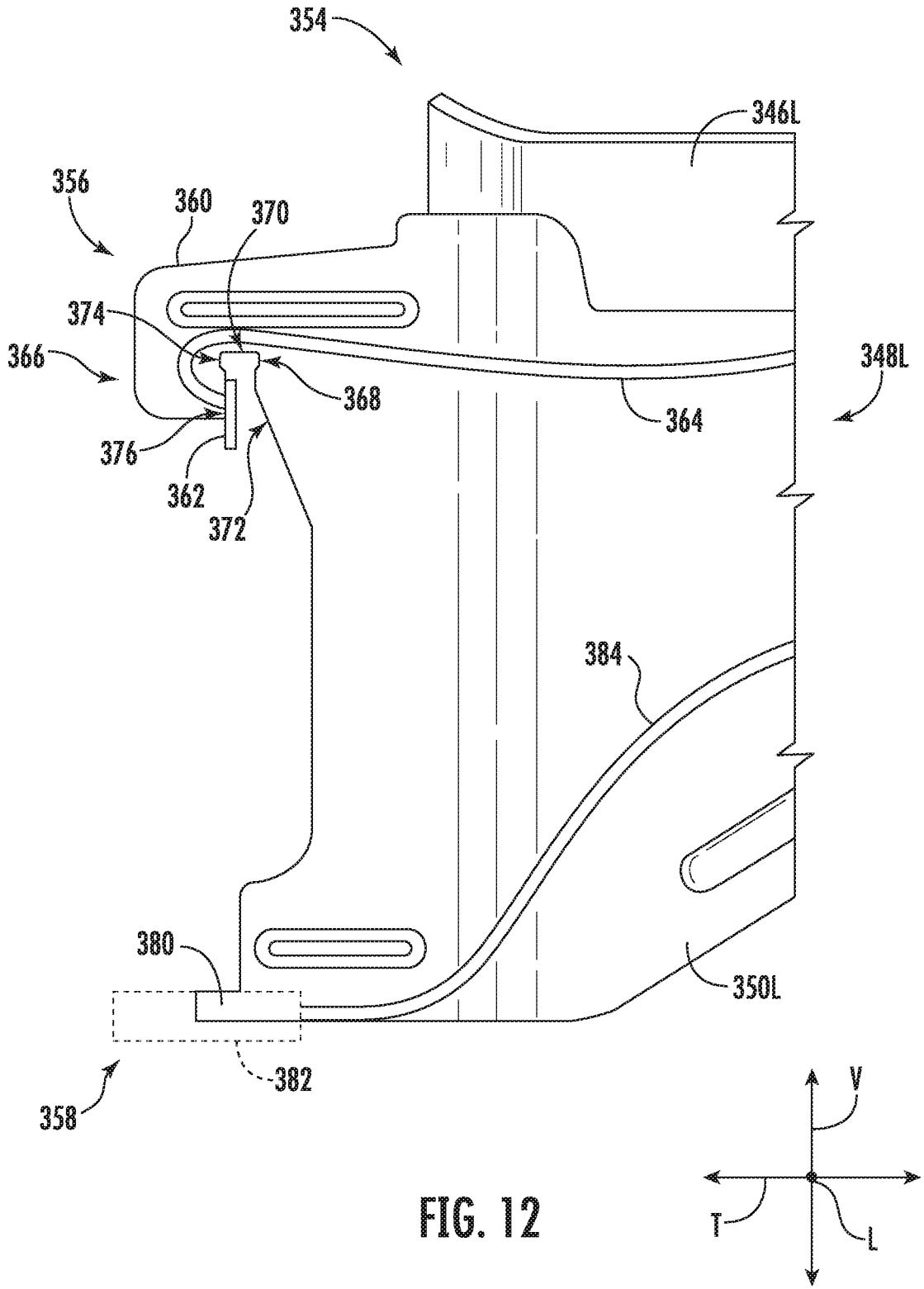
FIG. 12 provides another view of Section A of FIG. 10 with the middle track omitted for clarity.

With general reference now to FIGS. 9 through 12, various views of one adjustable shelf 170 mounted to tracks 180B, 180C are provided according to exemplary embodiments of the present subject matter. In particular, FIG. 9 provides a front perspective view of adjustable shelf 170 mounted to middle track 180B and right hand track 180C; FIG. 10 provides a side view of adjustable shelf 170 of FIG. 9 mounted to middle track 180B; FIG. 11 provides a close-up view of Section A of FIG. 10; and FIG. 12 provides another view of Section A of FIG. 10 with middle track 180B omitted for clarity.

With specific reference to FIG. 9, adjustable shelf 170 includes a shelf panel 340 having a top surface and a bottom surface. A frame extends around a perimeter of shelf panel 340. The frame includes a front member 342, a rear member 344, and a pair of side members 346L, 346R are affixed to the edges of shelf panel 340 around its perimeter. Front, rear, and side members 342, 344, 346L, 346R can be made of any suitable materials, such as metal or plastic, and shelf panel 340 can be made of any suitable material as well. In this embodiment, shelf panel 340 is a tempered glass.

Shelf 170 includes a pair of brackets attached to or formed integrally with shelf 170 for mounting shelf 170 to at least two of tracks 180A, 180B, 180C in one of the shelf mounting positions. For this embodiment, shelf 170 includes a left bracket 348L attached to left side member 346L and a right bracket 348R attached to right side member 346R. Left bracket 348L includes a body 350L that extends between a first end 352 and a second end 354 along the transverse direction T. Left bracket 348L extends in the vertical direction V between a top end 356 and a bottom end 358, which is shown more clearly in FIG. 12. In a similar manner, right bracket 348R includes a body 350R that extends between a first end and a second end along the transverse direction T. Right bracket 348R also extends in the vertical direction V between a top end and a bottom end.

With reference specifically now to FIGS. 10 through 12, left bracket 348L includes a first tab 360 extending from second end 354 of body 350L. For this embodiment, first tab 360 extends from second end 354 in the transverse direction T and is located proximate top end 356 of left bracket 348L. First tab 360 includes a first electrical connector 362, which is connected to a first wire 364 that provides for electrical communication between first electrical connector 362 and USB port 172 of shelf 170. With the use of first wire 364, left bracket 348L need not be an electrically conducting or corrosion-resistant material, as first wire 364 decouples the load bearing and electrical functionality of left bracket 348L. Although first wire 364 is illustrated as being visible in the figures, it will be appreciated that a casing or housing may hide first wire 364 from view in some exemplary embodiments. USB port 172 is located along a top surface of side member 346R in this example embodiment, but USB port 172 can be located in other suitable locations on shelf 170 as well.

As detailed in FIG. 12, first tab 360 includes a hook 366 for securing shelf 170 to middle track 180B. Hook 366 includes a first curved surface 368 that transitions first tab 360 from a bracket face 372, which may be a generally vertical face as shown, to a support face 370, which extends substantially along transverse direction T and is substantially planar with the transverse and lateral directions T, L. When shelf 170 is inserted into one of the openings 182B (FIG. 3) of middle track 180B, support face 370 of hook 366 engages a bottom edge of an aperture defined by first support member 300. In this way, first support member 300 at least partially supports the weight of shelf 170 when it is mounted to middle track 180B.

A second curved surface 374 transitions support face 370 to a vertical face 376. Vertical face 376 is oriented substantially along the vertical direction V and is substantially opposed to bracket face 372. First electrical connector 362 is positioned on the hook 366, and in particular, first electrical connector 362 is positioned on or is integral with the vertical face 376 of hook 366. When hook 366 is inserted into one of the mounting openings 182B of middle track 180B, first electrical connector 362 positioned on vertical face 376 engages a rear surface of right first bus bar 304R, as shown in FIG. 11. In this manner, first electrical connector 362 is in electrical communication with right first bus bar 304R. Moreover, as adjustable shelf 170 is cantilevered from middle track 180B when mounted thereto, first electrical connector 362 is biased in engagement with right first bus bar 304R as vertical face 376 tends to compress first electrical connector 362 with the rear surface of right first bus bar 304R, providing a secure mating of the two electrical components. Moreover, when first electrical connector 362 engages right first bus bar 304R, first wire 364 becomes electrically charged with the charge of right first bus bar 304R, which in this example embodiment is a ground charge GND as depicted in FIG. 6. Thus, first wire 364 can carry the ground charge GND or provide a grounding wire to USB port 172.

Referring still to FIGS. 11 and 12, left bracket 348L also includes a second tab 380 (FIG. 12). Second tab 380 extends from second end 354 of body 350L. For this embodiment, second tab 380 extends from second end 354 in the transverse direction T and is located proximate bottom end 358 of left bracket 348L. As shown, a second electrical connector 382 (shown transparent in FIG. 12) is positioned on or integral with second tab 380. Second electrical connector 382 is connected to a second electrical wire 384 that provides for electrical communication between second electrical connector 382 and USB port 172 of shelf 170. With the use of second wire 384, left bracket 348L need not be an electrically conducting or corrosion-resistant material, as second wire 384 decouples the load bearing and electrical functionality of left bracket 348L. Although second wire 384 is illustrated as being visible in the figures, it will be appreciated that a casing or housing may hide second wire 384 from view in some exemplary embodiments. First wire 364 and second wire 384 can extend along left bracket 348L as shown in FIG. 9 and can extend to right bracket 348R along front member 342 and/or rear member 344 and then along right bracket 348R to USB port 172.

With specific reference to FIG. 11, when shelf 170 is mounted to middle track 180B at one of the shelf mounting positions, second electrical connector 382 is configured to be in electrical communication with right second bus bar 308R. Specifically, second electrical connector 382 contacts a front surface of right second bus bar 308R. A front surface of first support member 300 and the front surface of right second bus bar 308R define a depth D1 of mounting opening 182R. Stated alternatively, depth D1 of mounting opening 182R extends between the front surface of first support member 300 and the front surface of right second bus bar 308R. When shelf 170 is mounted to middle track 180B, left bracket 348L and its second electrical connector 382 extend a distance greater than the depth D1 of mounting opening 182R in such a way that second electrical connector 382 deflects right second bus bar 308R, biasing right second bus bar 308R against second electrical connector 382. Biasing right second bus bar 308R against second electrical connector 382 provides a secure mating of the two electrical components. The deflection of right second bus bar 308R caused by second electrical connector 382 is exaggerated in FIG. 11 for illustrative purposes. When second electrical connector 382 engages right second bus bar 308R, second wire 384 becomes electrically charged with the charge of right second bus bar 308R, which in this example embodiment is a power or voltage charge VCC as depicted in FIG. 6. Thus, second wire 384 can carry the power or voltage charge to USB port 172.

With reference to FIGS. 7 and 9, right bracket 348R is shown mounted to right hand track 180C. Right bracket 348R of shelf 170 can be mounted to right hand track 180C in the same manner as described above with respect to left bracket 348L mounted to middle track 180B. Notably, when the first electrical connector of right bracket 348R engages first bus bar 324 a first wire (not shown) of right bracket 348R becomes electrically charged with the charge of first bus bar 324, which in this example embodiment is a negative data charge D− as depicted in FIG. 7. Thus, the first wire can carry the negative data charge to USB port 172. Furthermore, when the second electrical connector of right bracket 348R engages second bus bar 328, the second wire of right bracket 348R becomes electrically charged with the charge of second bus bar 328, which in this example embodiment is a positive data charge D+ as depicted in FIG. 7. Thus, the second wire can carry the positive data charge D+ to USB port 172.

Accordingly, when shelf 170 is mounted to middle track 180B and right hand track 180C as depicted in FIG. 9, the ground GND, power VCC, and data signal D−, D+ pins of USB port are electrically charged at least in part by the bus bars of middle track 180B and right hand track 180C. Particularly, functionality can be provided to USB port 172 by right first bus bar 304R of middle track 180B (FIG. 6) and its associated electrical wiring providing the ground charge GND, right second bus bar 308R of middle track 180B (FIG. 6) and its associated electrical wiring providing the power charge VCC, first bus bar 324 of right hand track 180C (FIG. 7) and its associated electrical wiring providing the negative data charge D− of the data signal, and second bus bar 328 of right hand track 180C (FIG. 7) and its associated electrical wiring providing the positive data charge D+ of the data signal. Thus, when a USB device is connected to USB port 172, the bus bars of the tracks enable USB functionality. Notably, shelf 170 can be adjusted or moved between or to different shelf mounting positions along the tracks and due to the configuration of the tracks, USB functionality is enabled no matter the selected shelf mounting position. Moreover, it will be appreciated that shelves can be mounted to left hand track 180A and middle track 180B in the same or similar manner noted above with respect to middle track 180B and right hand track 180C.

Figure 13:
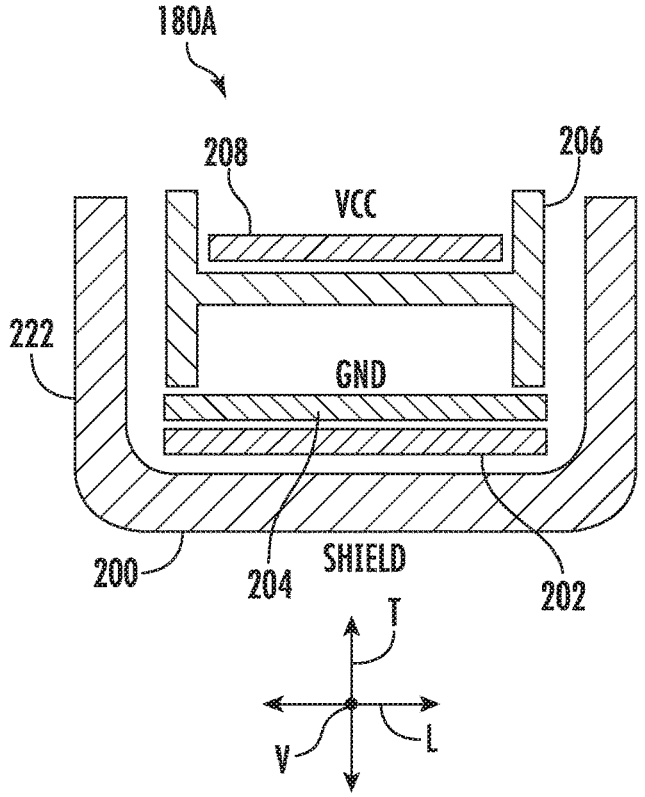
FIGS. 13 and 14 provide schematic top cross-sectional views of a first track and a second track that can be employed in the refrigerator appliance of FIG. 1.
Figure 14:
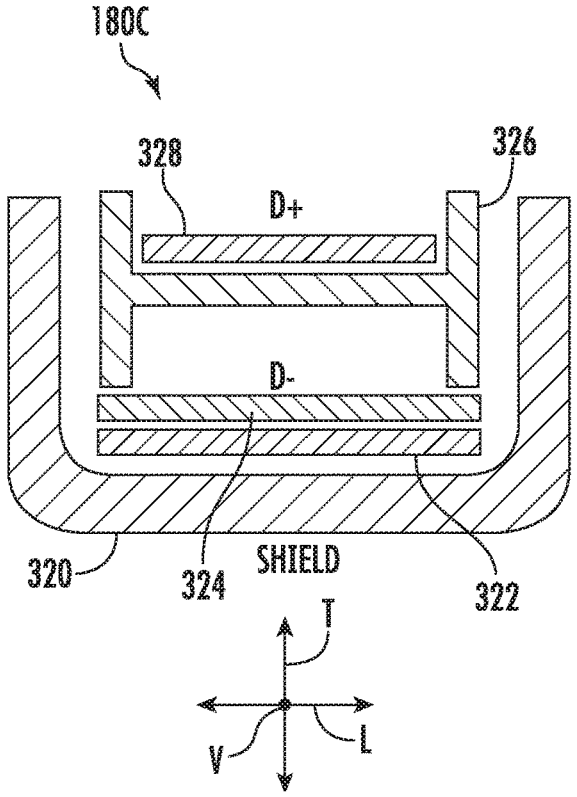

With reference now to FIGS. 13 and 14, schematic top cross-sectional views of a first track or left hand track 180A and a second track or right hand track 180B are depicted. Left hand track 180A and right hand track 180B of FIGS. 13 and 14 are similarly configured as the left hand track and right hand track of FIGS. 5 and 7, respectively. As will be appreciated in view of teachings disclosed herein, when a shelf is mounted to left hand track 180A and right hand track 180B at one of the shelf mounting positions, USB functionality is enabled when the electrical connectors engage the charged bus bars 204, 208 of left hand track 180A and the charged bus bars 324, 328 of right hand track 180C. Accordingly, in some embodiments, a two-track embodiment can provide a USB port of the shelf with USB functionality.

Figure 15:
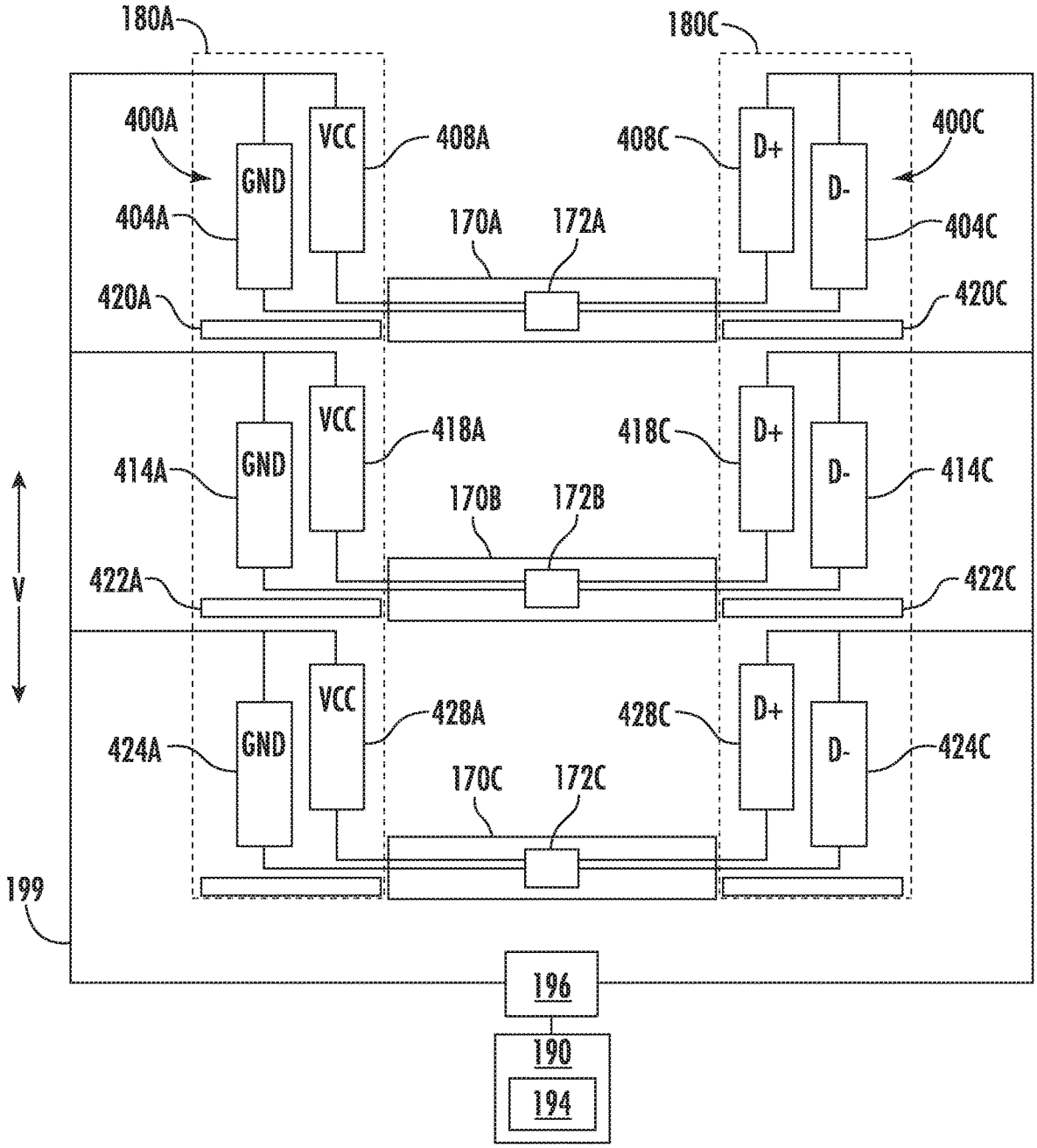
FIG. 15 a schematic view of an example system for providing USB functionality to USB ports of shelves according to an exemplary embodiment of the present subject matter.

In some further embodiments, shelf mounting tracks can provide USB functionality to USB ports of multiple shelves disposed within a chamber of an appliance. For instance, FIG. 15 provides a schematic view of an example system for providing USB functionality to USB ports 172A, 172B, 172C of shelves 170A, 170B, 170C, respectively. As shown, the system includes a first or left hand track 180A and a second or right hand track 180C. Left hand track 180A and right hand track 180C of FIG. 15 can be configured in the same or similar manner as the left hand track and right hand track of FIGS. 5 and 7, respectively, except that the first and second bus bars of left hand track 180A and right hand track 180B are split into sections along the vertical direction V.

As shown in FIG. 15, left hand track 180A includes a first bus bar pair 400A that includes a first bus bar 404A and a second bus bar 408A, a second bus bar pair 402A that includes a first bus bar 414A and a second bus bar 418A, and a third bus bar pair 406A that includes a first bus bar 424A and a second bus bar 428A. In a similar manner, right hand track 180C includes a first bus bar pair 400C that includes a first bus bar 404C and a second bus bar 408C, a second bus bar pair 402C that includes a first bus bar 414C and a second bus bar 418C, and a third bus bar pair 406C that includes a first bus bar 424C and a second bus bar 428C. First bus bar pair 400A is positioned above second bus bar pair 402A along the vertical direction V, and second bus bar pair 402A is positioned above third bus bar pair 406A along the vertical direction V. Similarly, first bus bar pair 400C is positioned above second bus bar pair 402C along the vertical direction V, and second bus bar pair 402C is positioned above third bus bar pair 406C along the vertical direction V. In some embodiments, electrically insulating dividers 420A, 422A and 420C, 422C can be positioned between the bus bar pairs along the vertical direction V, e.g., to electrically isolate the bus bars from adjacent bus bars. In some embodiments, a gap is defined between vertically adjacent bus bars.

Each bus bar 404A, 408A, 414A, 418A, 424A, 428A and 404C, 408C, 414C, 418C, 424C, 428C can be electrically charged with at least one of the power charge VCC, the ground charge GND, the positive data charge D+, and the negative data charge D-. For this embodiment, first bus bars 404A, 414A, and 424A are charged with a ground charge GND, second bus bars 408A, 418A, and 428A are charged with a power charge VCC, first bus bars 404C, 414C, and 424C are charged with a negative data charge D−, and second bus bars 408C, 418C, and 428C are charged with a positive data charge D+. All of the bus bars are electrically isolated from one another. The first support member of left hand track 180A and right hand track 180C can provide shielding functionality.

Notably, first bus bar 404A and second bus bar 408A of first bus bar pair 400A and first bus bar 404C and second bus bar 408C of first bus bar pair 400C are in electrical communication with the universal serial bus port 172A of first shelf 170A. First bus bar 414A and second bus bar 418A of second bus bar pair 402A and first bus bar 414C and second bus bar 418C of second bus bar pair 402C are in electrical communication with the universal serial bus port 172B of second shelf 170B. First bus bar 424A and second bus bar 428A of third bus bar pair 406A and first bus bar 424C and second bus bar 428C of third bus bar pair 406C are in electrical communication with the universal serial bus port 172C of third shelf 170C. Accordingly, for this embodiment, USB ports 172A, 172B, 172C of multiple shelves 170A, 170B, 170C can be enabled with USB functionality.

Referring again to FIG. 2, in some example embodiments, a door USB assembly 500 of one or both of refrigerator doors 128 can enable transmission of digital data between controller 190 and a USB device connected to a USB port 502 located on a bin 166 or drawer positioned therein and can enable electrical power transmission to the connected USB device.

Figure 16:
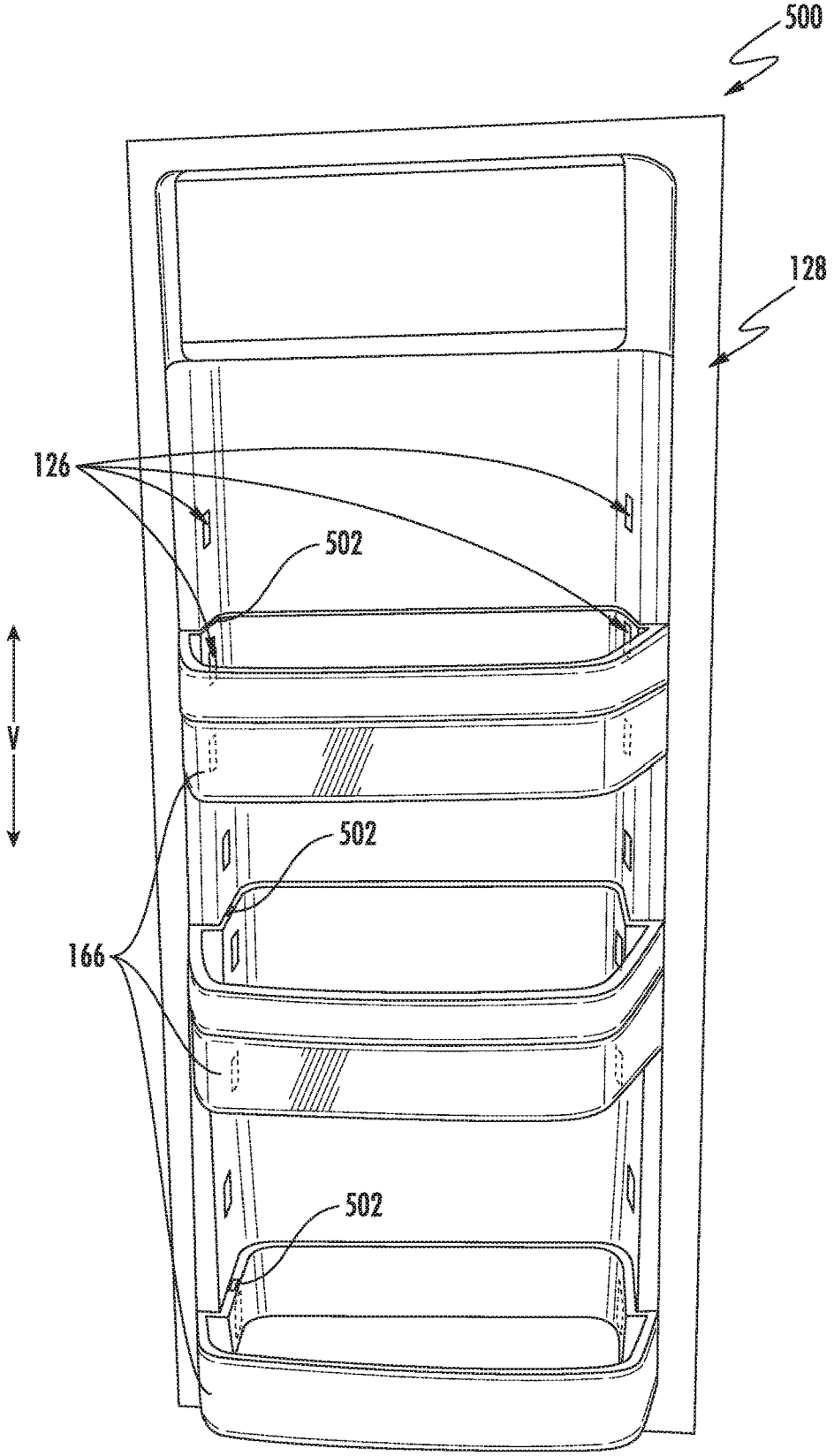
FIG. 16 provides a perspective view of a refrigerator door of the refrigerator appliance of FIG. 1.

Referring now to FIG. 16, door USB assembly 500 includes at least one storage bin 166. In some embodiments, door USB assembly 500 can include a plurality of storage bins 166. For example, as depicted in FIG. 16, door USB assembly 500 includes three (3) storage bins 166. Those of ordinary skill in the art, using the disclosures provided herein, will understand that any number of storage bins 166 can be used without deviating from the scope of the present disclosure. Each storage bin 166 can include a USB port. For example, as depicted in FIG. 16, each storage bin 166 includes USB port 502. A USB device can be connected to any of the USB ports 502. The USB ports 502 can be any suitable type of USB port. As will be discussed in greater detail herein, a track disposed on the door can facilitate digital data transmission between one of the USB ports 502 and a processing device, such as controller 190 (FIG. 1), when one of the storage bins 166 is engaged with the track. Additionally, when multiple storage bins 166 are engaged with the track, the track can be configured to route digital data transmissions between controller 190 and each USB port 502 such that multiple USB devices can be connected at once.

Each storage bin 166 is mountable to refrigerator door 128 by one or more mounting devices 126 (as shown on FIG. 16, some of which are depicted in phantom). A plurality of mounting devices 126 can be included on refrigerator door 128 such that each storage bin 166 can be mounted to refrigerator door 128 in a plurality of mounting positions. For example, refrigerator door 128 can extend between a top and a bottom, e.g., along the vertical direction V. One storage bin 166 can be mounted in a first position toward the top of refrigerator door 128, or mounted in a second position toward the bottom of refrigerator door 128. One storage bin 166 can also be mounted in any number of other mounting positions. In this way, each storage bin 166 is mountable in a number of mounting positions. Each storage bin 166 can further be configured to engage with the track regardless of whether the storage bin 166 is in the first position, the second position, or any other mounting position.

Figure 17:
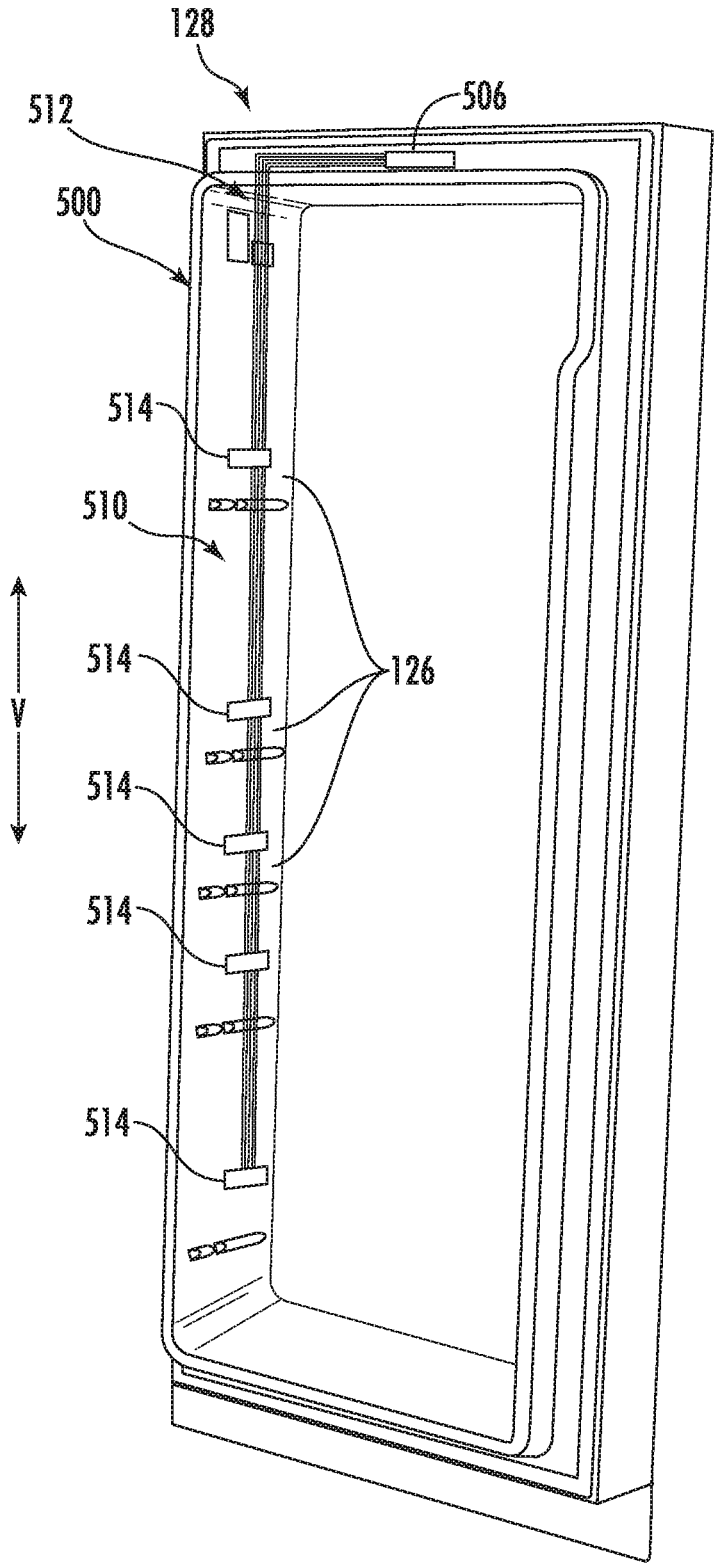
FIG. 17 provides a perspective view of the refrigerator door and schematically depicts a track of a door USB assembly thereof.

For this embodiment, the mounting devices 126 are nubbins. Each nubbin has an associated opposing nubbin and thus door 128 includes matched pairs of nubbins, wherein each matched pair of nubbins is configured to receive and support a storage bin 166, e.g., as shown in FIG. 16. Each matched pair of nubbins can be located at a consistent distance apart from each other such that one of the storage bins 166 can be mounted on any matched pair of nubbins FIG. 17 provides a perspective view of refrigerator door 128 and schematically depicts a track 510 of door USB assembly 500. As shown, track 510 is disposed on door 128. For instance, track 510 can be attached to an inner liner of door 128 as shown in FIG. 17. Track 150 includes a plurality of USB lines 512. For this embodiment, the USB lines 512 include a power line, a ground line, a positive data line, a negative data line, and shielding line. The power line is charged with a power charge VCC, the ground line is charged with a ground charge GND, the positive data line is charged with a positive data charge D+, the negative data line is charged with a negative data charge D−, and the shielding line is charged with a shielding charge. USB lines 512 are in electrical communication with a centralized hub 506 in electrical communication with controller 190 (FIG. 1), e.g., via one or more USB conduits. Centralized hub 506 facilitates digital data transmissions between the controller 190 and the USB ports 502 of storage bin 166. Track 510 also includes one or more connectors in electrical communication with the USB lines 512. For this embodiment, track 510 includes a plurality of connectors 514.

Figure 18:
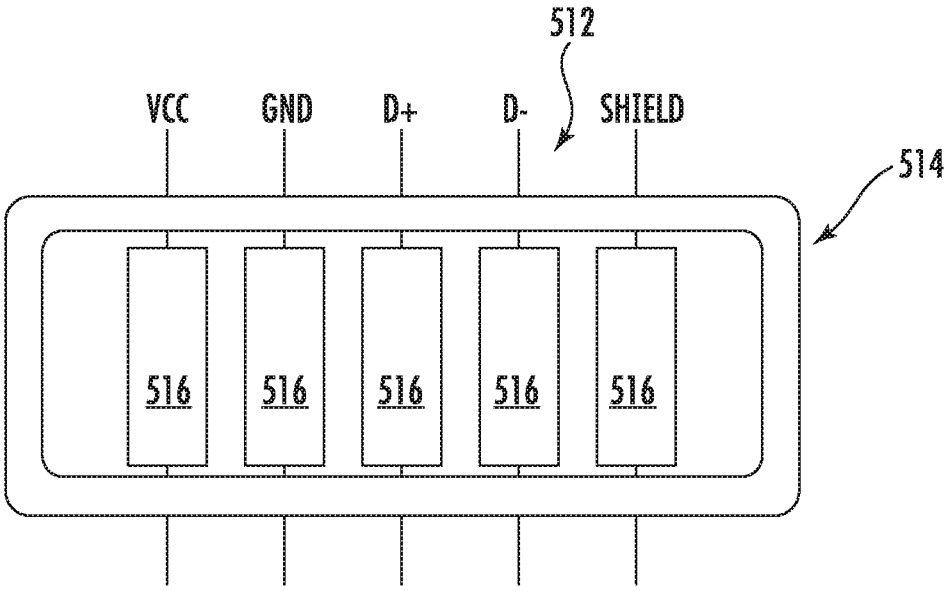
FIG. 18 provides a close up view of one example connector of the track of the door USB assembly of FIG. 17.

FIG. 18 provides a close up view of one example connector 514. As shown, connector 514 has a plurality of electrically conducting plates 516. Each plate 516 is in electrical communication or electrically connected with one of the USB lines 512. Thus, as depicted, at least one of the plurality of plates 516 is charged with a power charge VCC, at least one of the plurality of plates 516 is charged with a ground charge GND, at least one of the plurality of plates 516 is charged with a positive data charge D+, at least one of the plurality of plates 516 is charged with a negative data charge D−, and for this embodiment, at least one of the plurality of plates 516 is charged with a shielding charge SHIELD. In some embodiments, optionally, connector 514 does not include a plate having a shielding charge.

Figure 19:
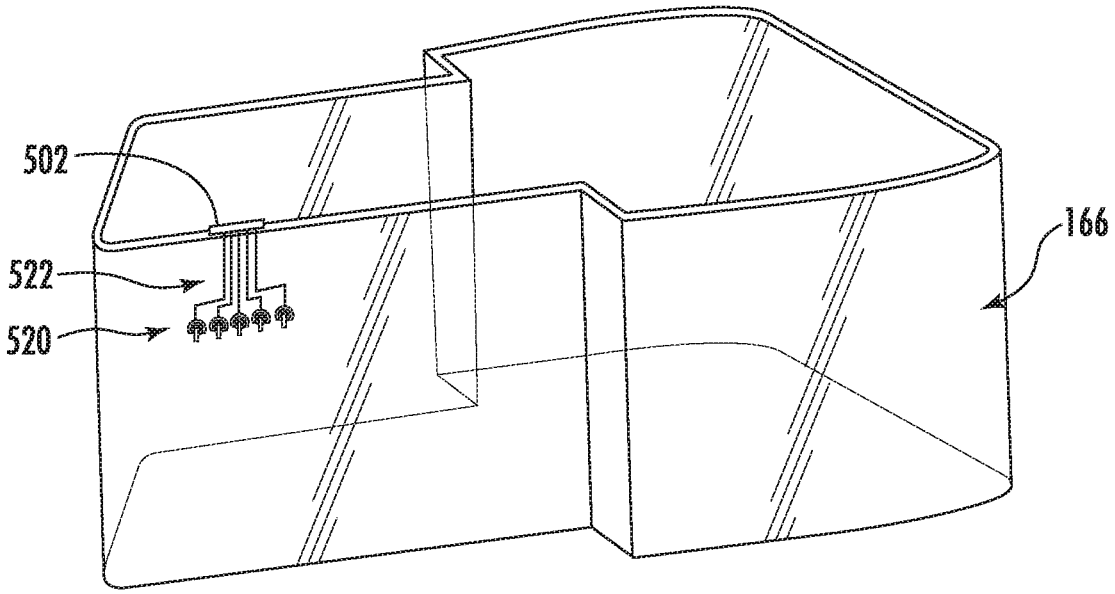
FIG. 19 provides a side view of one example storage bin according to example aspects of the present disclosure.

FIG. 19 provides a side view of one example storage bin 166 according to example aspects of the present disclosure. As depicted, storage bin 166 has a USB port 502 and a plurality of electrical contacts 520. For this embodiment, storage bin 166 has five (5) electrical contacts; however, in other embodiments, storage bin 166 has only four (4) electrical contacts. The plurality of electrical contacts 520 are in electrical communication with USB port 502 via bin USB lines 522.

Moreover, for this embodiment, the electrical contacts 520 are spring pin contacts configured to make an electrical connection with track 510 when storage bin 166 is engaged with track 510. Other types of electrical contacts 520 can be used as well. As depicted in FIG. 19, the spring pin contacts 520 can be mounted on a side of storage bin 166. In other embodiments, the spring pin connectors 520 can be located in any alternate location on storage bin 166. Each spring pin contact 520 can include a spring (not depicted) configured to depress a contactor such that the contactor makes an electrical connection with one of the plates 516 of connector 514 when storage bin 166 is mounted to door 128.

More particularly, when storage bin 166 is mounted to door 128 (FIG. 16), each of the plurality of electrical contacts 520 of storage bin 166 engage a respective one of the plurality of plates 516 of connector 514 (FIG. 18). When this occurs, the plurality of plates 516 are in electrical communication with USB port 502 of storage bin 166. As the plates 516 are each charged with their respective charges VCC, GND, D+, D−, and optionally, SHIELD, the charges are passed from the plates 516 of connector 514 to electrical contacts 520 of storage bin 166 and are carried by bin USB lines 522 to respective pins of USB port 502.

Figure 20:
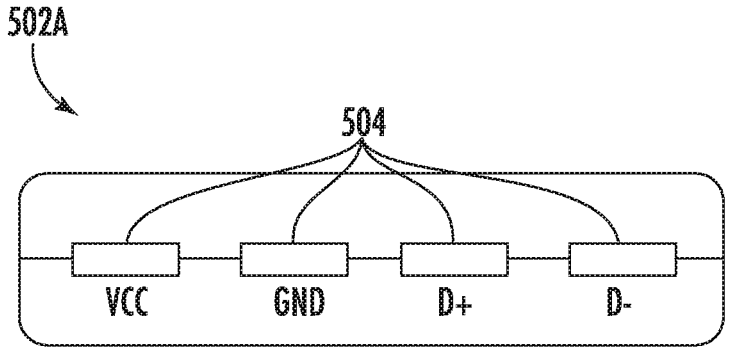
FIGS. 20 and 21 provide example USB ports according to example aspects of the present disclosure.
Figure 21:
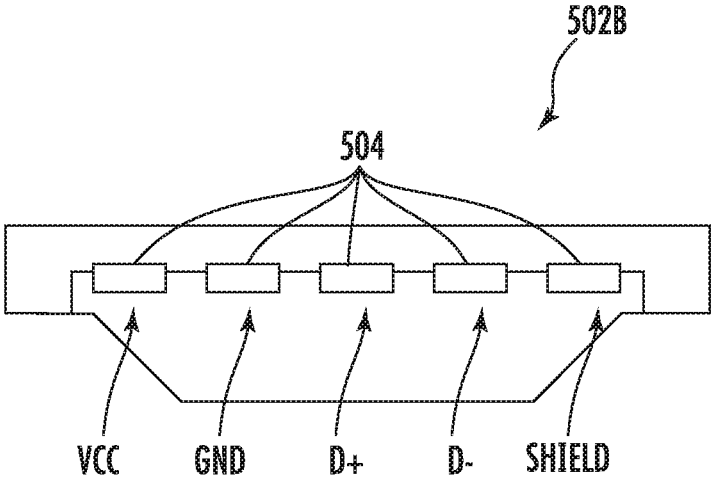

FIGS. 20 and 21 provide example USB ports. As shown in FIG. 20, some USB ports 502A can include four (4) pins 504. One pin 504 corresponds to a power pin and is charged with the power charge VCC, one pin corresponds to a ground pin and is charged with the ground charge GND, one pin 504 corresponds to a positive data pin and is charged with the positive data charge D+, and one pin 504 corresponds to a negative data pin and is charged with the negative data charge D− when the contacts 520 engage their respective plates 516 of connector 514. As shown in FIG. 21, some USB ports 502B can include five (5) pins 504 that correspond to pins described above with reference to FIG. 20, and in addition, one pin 504 corresponds to a shield or shielding pin and is charged with the shielding charge (e.g., ground) when the contacts 520 engage their respective plates 516 of connector 514. USB ports 172 (FIG. 2) can be configured in the same or similar manner as USB ports 502A and/or 502B of FIGS. 20 and 21.

Digital data transmissions are routable between USB port 502 of storage bin 166 and controller 190 or some or processing device. For instance, a USB device connected with USB port 502 can send a data transmission to controller 190. The data transmission is first routed to the pins of USB port 502. The data transmission continues along the USB lines 522 to contact 520. As the contacts 520 are engaged with their respective plates 516 of connector 514 of track 510, the data transmission is transferred from bin 166 to door 128. The data transmission continues along USB lines 512 of track 510 to centralized hub 506. Centralized hub 506 can then route the data transmission to controller 190 (FIG. 1) or some other processing device. As will be appreciated, data transmission and electrical power can be delivered to USB port 502 and a USB device connected thereto as noted above except in a reverse order.

Figure 22:
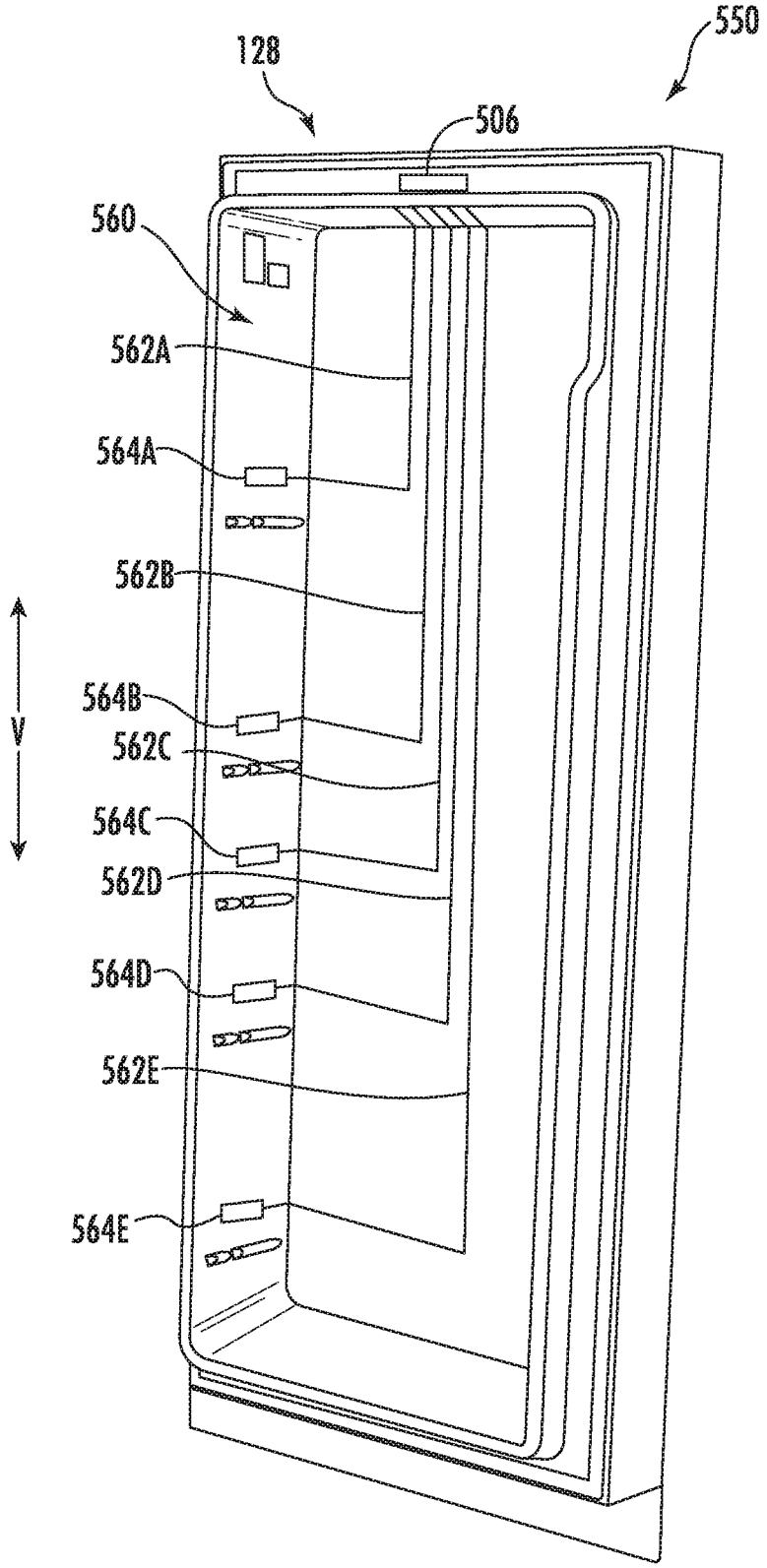
FIG. 22 provides a perspective view of another refrigerator door and schematically depicts a track of a door USB assembly thereof.

With reference now to FIG. 22, a perspective view of another refrigerator door 128 is provided. In FIG. 22, a track 560 of a door USB assembly 550 is schematically depicted. For this embodiment, track 560 includes a plurality of connectors 564A, 564B, 564C, 564D, and 564E. Each connector 564A, 564B, 564C, 564D, and 564E is in electrical communication with centralized hub 506, which is communicatively coupled with controller 190 (FIG. 1). A USB conduit 562A having a plurality of USB lines electrically connects centralized hub 506 with connector 564A. Similarly, USB conduits 562B, 562C, 562D, 562E each having a plurality of USB lines electrically connect centralized hub 506 with the respective connectors 564B, 564C, 564D, 564E. The USB lines of each USB conduit 562A, 562B, 562C, 562D, 562E can include a power line, a ground line, a positive data line, a negative data line, and optionally, a shielding line. The power line is charged with a power charge, the ground line is charged with a ground charge the positive data line is charged with a positive data charge, the negative data line is charged with a negative data charge, and the shielding line is charged with a shielding charge.

Each connector 564A, 564B, 564C, 564D, and 564E has a plurality of plates. For instance, each connector 564A, 564B, 564C, 564D, and 564E can be similarly configured as the connector 514 of FIG. 18. Notably, for each connector 564A, 564B, 564C, 564D, 564E at least one of the plurality of plates is charged with a power charge, at least one of the plurality of plates is charged with a ground charge, at least one of the plurality of plates is charged with a positive data charge, and at least one of the plurality of plates is charged with a negative data charge. In some embodiments, at least one of the plurality of plates is charged with a shielding charge.

In such embodiments, a plurality of storage bins 166 can be mounted to refrigerator door 128, e.g., as shown in FIG. 16. Each bin 166 can have a USB port and a plurality of electrical contacts, e.g., as shown in FIG. 19. When the plurality of storage bins 166 are mounted to the refrigerator door 128 and the plurality of electrical contacts 520 of each of the plurality storage bins 166 engage a respective one of the plurality of plates 516 of each of the plurality of connectors 564A, 564B, 564C, 564D, 564E, digital data transmissions are routable between the USB port 502 of each of the plurality of storage bins 166 and the controller 190. Stated differently, in some embodiments, multiple USB devices connected to the USB ports 502 can send data transmissions at the same time as USB door assembly 550 includes five (5) distinct connectors 564A, 564B, 564C, 564D, 564E in this example embodiment.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

a cabinet defining a chamber;

a door coupled to the cabinet to provide selective access to the chamber;

a first track disposed within the chamber of the cabinet, the first track comprising:

a first bus bar electrically charged with a power charge; and a second bus bar electrically isolated from the first bus bar and electrically charged with a ground charge;

a second track disposed within the chamber of the cabinet and spaced from the first track, the second track comprising:

a first bus bar electrically charged with a positive data charge; and a second bus bar electrically isolated from the first bus bar of the second track, the second bus bar of the second track being electrically charged with a negative data charge; and a shelf having a universal serial bus port and mounted to the first track and the second track such that the first bus bar and the second bus bar of the first track and the first bus bar and the second bus bar of the second track are in electrical communication with the universal serial bus port.

2. The appliance of claim 1, wherein the first track further comprises:

a first support member formed of an electrically conductive material;

an insulating member formed of a non-electrically conductive material and coupled with the first support member, wherein the insulating member electrically isolates the first support member from the first bus bar of the first track.

3. The appliance of claim 2, wherein the first support member is connected to an electrical ground and is in electrical communication with the universal serial bus port.

4. The appliance of claim 1, wherein the first bus bar and the second bus bar of the first track and the first bus bar and the second bus bar of the second track are each electrically charged with a different one of the power charge, the ground charge, the positive data charge, and the negative data charge.

5. The appliance of claim 1, wherein the first track extends between a top portion and a bottom portion, and wherein the first bus bar and the second bus bar of the first track extend substantially between the top portion and the bottom portion of the first track.

6. The appliance of claim 1, wherein the shelf is an adjustable shelf, and wherein the first track and the second track provide a plurality of shelf mounting positions at which the adjustable shelf is mountable, and wherein the first bus bar and the second bus bar of the first track and the first bus bar and the second bus bar of the second track are in electrical communication with the universal serial bus port of the shelf when the shelf is mounted at any of the plurality of shelf mounting positions.

7. The appliance of claim 1, wherein the shelf has a first bracket mounted to the first track and a second bracket mounted to the second track, and wherein the first bracket and the second bracket each comprise:

a body extending between a first end and a second end;

a first tab extending from the second end of the body and having a first electrical connector; and a second tab extending from the second end of the body and having a second electrical connector, wherein when the shelf is mounted to the first track, the first electrical connector of the first bracket is in electrical communication with the first bus bar of the first track and the second electrical connector of the first bracket is in electrical communication with the second bus bar of the first track; and wherein when the shelf is mounted to the second track, the first electrical connector of the second bracket is in electrical communication with the first bus bar of the second track and the second electrical connector of the second bracket is in electrical communication with the second bus bar of the second track.

8. The appliance of claim 1, further comprising:

a controller;

a centralized hub in electrical communication with the controller;

one or more universal serial bus conduits providing electrical communication between the centralized hub and the first bus bar and the second bus bar of the first track and electrical communication between the centralized hub and the first bus bar and the second bus bar of the second track, and wherein the centralized hub facilitates data transmissions between the controller and the USB port of the shelf.

9. The appliance of claim 1, wherein the first track further comprises:

a third bus bar electrically isolated from the first bus bar and the second bus bar of the first track, the third bus bar being electrically charged with at least one of the power charge, the ground charge, the positive data charge, and the negative data charge; and a fourth bus bar electrically isolated from the third bus bar and the first bus bar and the second bus bar of the first track, the fourth bus bar being electrically charged with at least one of the power charge, the ground charge, the positive data charge, and the negative data charge.

10. The appliance of claim 9, wherein the appliance defines a vertical direction, a lateral direction, and a transverse direction mutually perpendicular to one another, and wherein the first bus bar of the first track is aligned with the second bus bar of the first track along the lateral direction and is spaced from the second bus bar of the first track along the transverse direction, and wherein the third bus bar is aligned with the fourth bus bar along the lateral direction and is spaced from the fourth bus bar along the transverse direction.

11. The appliance of claim 10, wherein the first track has a divider formed of an insulating material positioned between a first pair of bus bars and a second pair of bus bars along the lateral direction, the first pair of bus bars including the first bus bar and the second bus bar of the first track and the second pair of bus bars including the third bus bar and the fourth bus bar.

12. The appliance of claim 1, wherein the appliance defines a vertical direction, a lateral direction, and a transverse direction mutually perpendicular to one another, and wherein the first track includes a first bus bar pair that includes the first bus bar and the second bus bar and a second bus bar pair comprising:

a third bus bar electrically isolated from the first bus bar and the second bus bar of the first bus bar pair and charged with at least one of the power charge, the ground charge, the positive data charge, and the negative data charge; and a fourth bus bar electrically isolated from the third bus bar and the first bus bar and the second bus bar of the first bus bar pair and electrically charged with at least one of the power charge, the ground charge, the positive data charge, and the negative data charge, and wherein the first bus bar and the second bus bar of the first bus bar pair are in electrical communication with the universal serial bus port of the shelf and the third bus bar and the fourth bus bar of the second bus bar pair are in electrical communication with a universal serial bus port of a second shelf mounted to the first track.

13. The appliance of claim 1, wherein the appliance is a refrigerator appliance.

* * * * *